US009802416B2

(12) United States Patent
Takagiwa

(10) Patent No.: US 9,802,416 B2
(45) Date of Patent: Oct. 31, 2017

(54) CARTRIDGE CASE

(71) Applicant: BROTHER KOGYO KABUSHIKI KAISHA, Nagoya-shi, Aichi-ken (JP)

(72) Inventor: Yutaka Takagiwa, Kariya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/270,451

(22) Filed: Sep. 20, 2016

(65) Prior Publication Data

US 2017/0087855 A1 Mar. 30, 2017

(30) Foreign Application Priority Data

Sep. 30, 2015 (JP) ..... 2015-194906

(51) Int. Cl.
*B41J 2/175* (2006.01)

(52) U.S. Cl.
CPC ..... *B41J 2/1752* (2013.01); *B41J 2/17513* (2013.01)

(58) Field of Classification Search
CPC B41J 2/17503; B41J 2/17506; B41J 2/17509; B41J 2/17513; B41J 2/1752; B41J 2/17523; B41J 2/17526; B41J 2/1753; B41J 2/17533; B41J 2/17536; B41J 2/1754; B41J 2/17556; B41J 2/17553; B41J 2/1755; B41J 2/17546; B41J 2/17543
See application file for complete search history.

(56) References Cited

U.S. PATENT DOCUMENTS

| | | | |
|---|---|---|---|
| 2001/0043256 | A1 | 11/2001 | Seccombe et al. |
| 2007/0243001 | A1 | 10/2007 | Samoto |
| 2008/0225093 | A1 | 9/2008 | Nozawa |
| 2008/0252702 | A1 | 10/2008 | Aoki et al. |
| 2010/0309264 | A1 | 12/2010 | Midorikawa |
| 2013/0038667 | A1 | 2/2013 | Bachar et al. |

FOREIGN PATENT DOCUMENTS

| | | | |
|---|---|---|---|
| JP | 2002-361882 | A | 12/2002 |
| JP | 2010-105195 | A | 5/2010 |
| JP | 2012/161978 | A | 8/2012 |
| WO | 2015/101571 | A1 | 7/2015 |

OTHER PUBLICATIONS

Extended European Search Report dated Nov. 29, 2016 issued in the corresponding European patent application No. 16189033.0.

*Primary Examiner* — Kristal Feggins
(74) *Attorney, Agent, or Firm* — K&L Gates LLP

(57) ABSTRACT

A cartridge case includes a case, a spout support portion, a mount portion, a roll-up member, and a resistance portion. The case includes a first face extending in a first direction. The spout support portion is configured to support a spout provided in a liquid container containing an inkjet liquid. An end portion on a first direction side of an elastic member is mountable in the mount portion. The elastic member generates an energizing force in the first direction. The roll-up member is configured to roll up the liquid container by being moved in the first direction by the energizing force of the elastic member. The resistance portion is configured to generate resistance to movement of the roll-up member in the first direction at the end portion side of the case. The resistance portion is configured to increase the resistance as the roll-up member moves in the first direction.

12 Claims, 20 Drawing Sheets

3
64
32
60
62
61
644
240
220
225
241
215
210
228
223
205
218
212
222
224
436
432
213
230
430
433
214
434
227
431
435
43
231
217
471
472
47
46
48
45
355
310
334
399
524A
524
335
484
479
481
479E
473
399
34
33
482
461
521
523
551
541
451
451
485
489
488
483
522
52
450
344
364
347
389
355
542
51
345
552
37
UP
345
(SECOND DIRECTION)
REAR
RIGHT
512
511
513
360
362
333A
333
346
LEFT
FRONT (FIRST DIRECTION)
DOWN
398
388
361
300

CARTRIDGE CASE

CROSS-REFERENCE TO RELATED APPLICATION

This application claims priority to Japanese Patent Application No. 2015-194906 filed Sep. 30, 2015. The contents of the foregoing applications are hereby incorporated herein by reference.

BACKGROUND

The present disclosure relates to a cartridge case that can accommodate a liquid container that contains a liquid.

A cartridge case is known that can accommodate a liquid container that contains a liquid. For example, an ink tank is known that supplies ink to a record head of an inkjet recording apparatus. The ink tank is an example of a cartridge case. The ink tank includes an ink bag, a case, and a roll-up member. The ink bag contains a liquid ink. The case accommodates the ink bag and can be mounted in and removed from the inkjet recording apparatus. The roll-up member is disposed inside the case and can roll up the ink bag. The inkjet recording apparatus includes a spring as the roll-up force generation member. When the ink tank is inserted into the inkjet recording apparatus, the roll-up member engages with the spring. The energizing force of the spring causes the roll-up member to roll up the ink bag and apply pressure to the ink.

SUMMARY

In the ink tank, as the consumption of the ink progresses, the cross-sectional surface area of the ink bag in the direction orthogonal to the direction in which the ink bag is rolled up becomes smaller. The pressure that the roll-up member applies to the ink inside the ink bag corresponds to the energizing force of the spring per unit cross-sectional surface area. Therefore, as the cross-sectional surface area of the ink bag becomes smaller, the pressure increases, even though the energizing force of the spring is constant. As the pressure increases, the force with which the ink is supplied to the record head increases, and thus the amount of the ejected ink becomes unstable. Therefore, the printing quality may deteriorate due to the instability in the ejection of the ink.

Embodiments of the broad principles derived herein provide a cartridge case that can reduce deterioration in printing quality by reducing fluctuation in liquid pressure and stabilizing the amount of ejected liquid.

Embodiments provide a cartridge case that includes a case, a spout support portion, a mount portion, a roll-up member, and a resistance portion. The case includes a first face extending in a first direction. The spout support portion is provided on an end portion side of the case. The end portion side is a side on which an end portion of the case is provided in the first direction. The spout support portion is configured to support a spout provided on a liquid container containing an inkjet liquid. An end portion on a first direction side of an elastic member is mountable in the mount portion. The mount portion is provided on the end portion side of the case. The elastic member extends in a second direction. The second direction is an opposite direction from the first direction. The elastic member generates an energizing force in the first direction. The roll-up member extends in an orthogonal direction. The orthogonal direction is a direction parallel to the first face and orthogonal to the first direction. The roll-up member is configured to roll up the liquid container by being moved in the first direction by the energizing force of the elastic member. The resistance portion is configured to generate resistance to movement of the roll-up member in the first direction at the end portion side of the case. The resistance portion is configured to increase the resistance as the roll-up member moves in the first direction.

BRIEF DESCRIPTION OF THE DRAWINGS

Embodiments will be described below in detail with reference to the accompanying drawings in which.

DETAILED DESCRIPTION

Figure 1:
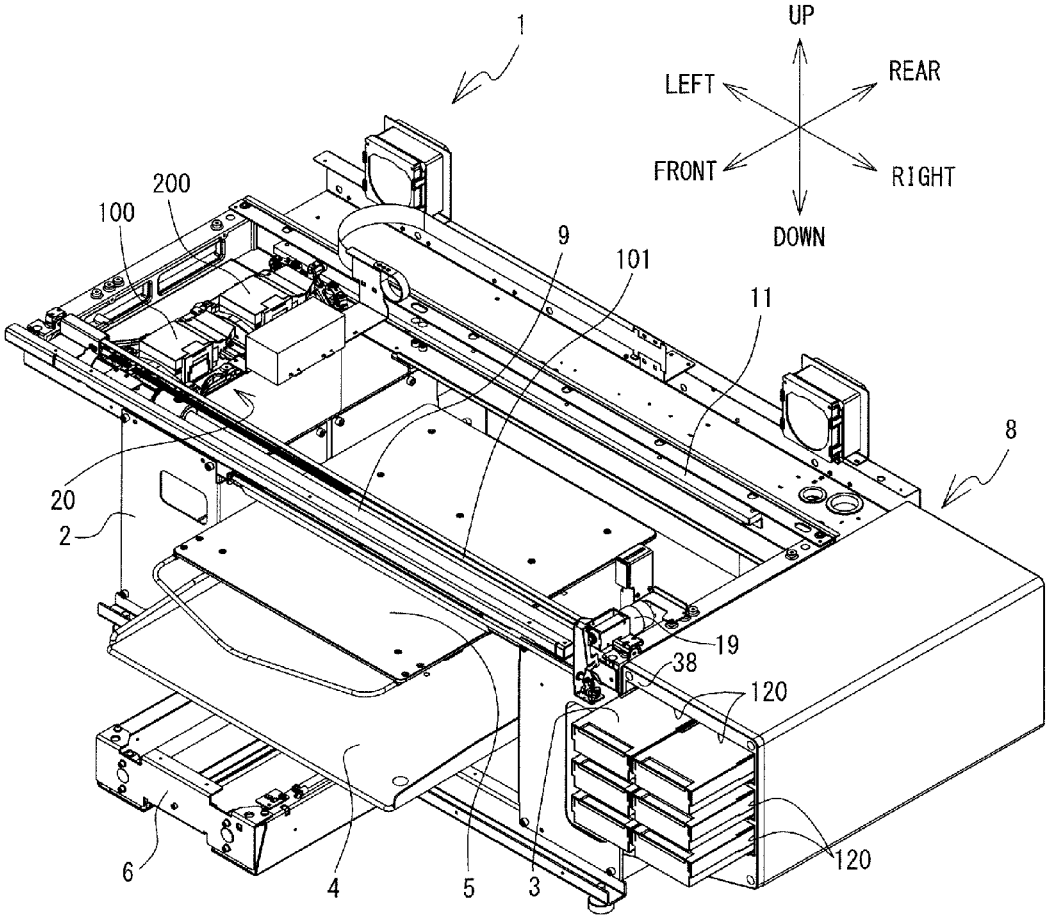
FIG. 1 is an oblique view of a printer of a first embodiment.

A printer 1 of a first embodiment will be explained with reference to the drawings. In the explanation that follows, the terms left, right, front, rear, up, and down that are used are those indicated by the arrows in the drawings. The overall structure of the printer 1 will be explained with reference to FIG. 1.

The printer 1 is an inkjet printer that performs printing by ejecting an ink onto a cloth (not shown in the drawings) such as a T-shirt. The ink is an example of a liquid. The cloth is a print medium. The print medium may be a paper or the like. The printer 1 can print a color image on the print medium by ejecting five different types of the ink (white, black, yellow, cyan, and magenta) downward.

The printer 1 includes a housing 2, a platen drive mechanism 6, a platen 5, a tray 4, a shaft 9, a rail 11, a carriage 20, head units 100, 200, a drive belt 101, and a drive motor 19. The housing 2 is substantially a three-dimensional rectangle. An operation portion (not shown in the drawings) is provided on the front side of the right portion of the housing 2. The operation portion is used to perform an operation of the printer 1. The operation portion includes a display and an operation button. The display displays various types of information.

The platen drive mechanism 6 is provided with a motor (not shown in the drawings) at the rear edge of the housing 2. The driving force of the motor moves the platen 5 and the tray 4 as a single unit in the front-rear direction of the housing 2 along a pair of rails (not shown in the drawings). The platen 5 is a plate that is rectangular in a plan view. The top face of the platen 5 serves as a placement surface for the print medium. The tray 4 is rectangular in a plan view and is disposed below the platen 5.

The top portion of the housing 2 has a frame body that is rectangular in a plan view. The frame body of the housing 2 supports the shaft 9 and the rail 11 on its inner side. The carriage 20 can be conveyed in the left-right direction along the shaft 9 in a higher position than the platen 5. The head units 100 and 200 are mounted on the carriage 20. A head portion (not shown in the drawings) is provided on the bottom face of each of the head units 100 and 200. Each of the head portions includes a plurality of nozzles. The operation of piezoelectric elements causes the head portions to eject droplets of the ink downward from the nozzles.

The drive belt 101 has a belt shape that spans the inner side of the frame body of the housing 2 in the left-right direction. The drive motor 19 is configured to rotate forward and in reverse. The drive motor 19 is coupled to the carriage 20 through the drive belt 101. The printer 1 performs printing on the print medium by causing the platen 5 to convey the print medium in the front-rear direction (a conveyance direction, a sub-scanning direction) and causing the head portions to eject the ink as the head portions are moved reciprocally in the left-right direction by the drive motor 19.

A cartridge mount portion 8 is provided on the right side of the printer 1. The inks supplied to the respective head portions of the head units 100 and 200 flow from cartridge cases 3 mounted in the cartridge mount portion 8. A plurality of cartridge cases 3, such as six cartridge cases 3, are mounted in the cartridge mount portion 8. A frame portion 38 is provided in the front portion of the cartridge mount portion 8. Openings 120 are provided in the frame portion 38 and are arrayed in three rows in the up-down direction and two columns in the left-right direction. Each one of the openings 120 has a shape that allows one of the cartridge cases 3 to be inserted into and removed from the each one of the openings 120. A spout 7 (refer to FIG. 2) of a liquid container 31 inside the cartridge case 3 includes a rubber plug (not shown in the drawings). The cartridge mount portion 8 is provided with hollow needles (not shown in the drawings) that correspond to the individual openings 120. When the cartridge case 3 is mounted in the cartridge mount portion 8, the hollow needle pierces the rubber plug, such that the hollow needle draws the ink out of the liquid container 31.

[Cartridge Case 3]

Figure 3:
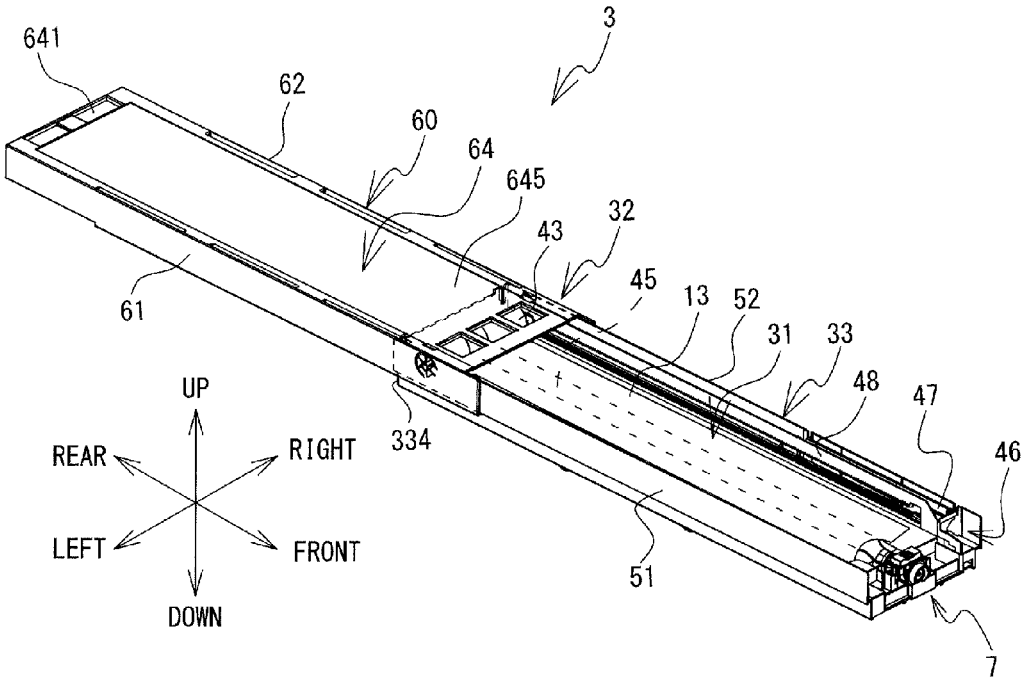
FIG. 3 is an oblique view of the cartridge case in which the second case is in an open position, as seen from above.

The direction from the rear side of the cartridge case 3 toward the front side is called the first direction. The opposite direction from the first direction is the direction from the front side of the cartridge case 3 toward the rear side and is called the second direction. As shown in FIG. 3, the cartridge case 3 includes the liquid container 31 and a case 32. The case 32 accommodates the liquid container 31 in its interior.

Figure 4:
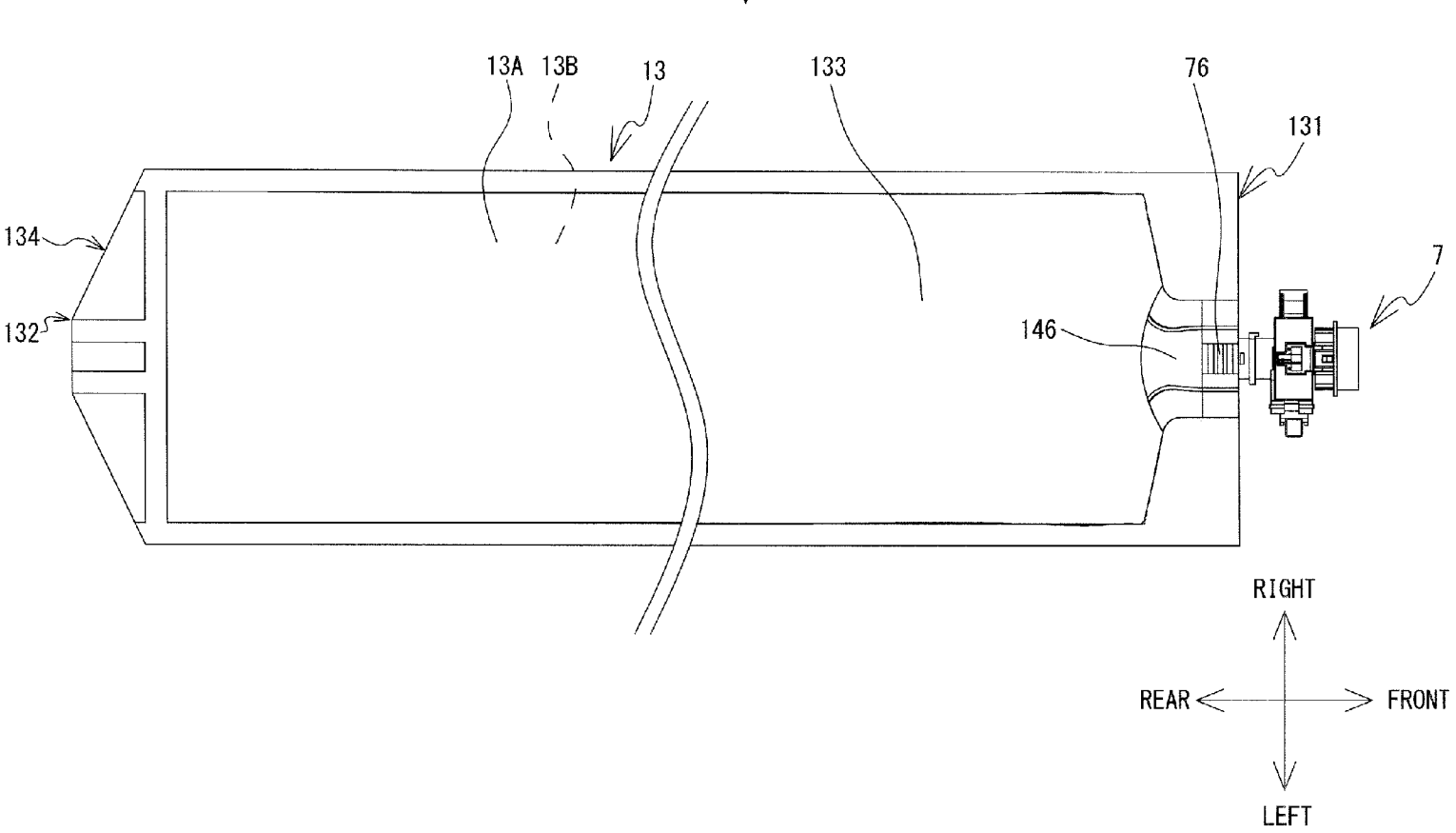
FIG. 4 is a plan view of a liquid container.

As shown in FIG. 4, the liquid container 31 includes a liquid bag 13 and the spout 7. The liquid bag 13 is a bag-shaped container formed by connecting peripheral edges of two sheets 13A and 13B in a state in which the sheets 13A and 13B are overlapped each other such that one face of the sheet 13A is opposed to one face of the sheet 13B. In the liquid bag 13, the peripheral edges of the two sheets 13A, 13B, which may be flexible, rectangular resin sheets, for example, are connected by one of heat welding and heat sealing. The liquid bag 13 extends in the front-rear direction. In the explanation that follows, the front edge of the liquid bag 13 is called the first edge 131. The rear edge of the liquid bag 13 is called the second edge 132.

The liquid bag 13 includes a liquid-holding portion 133 and an extension portion 134. A liquid is contained in the interior of the liquid portion 133. The liquid may be an ink, a discharge agent that decolorizes a dyed cloth, or the like. In the present embodiment, the liquid is an ink. The extension portion 134 is a portion of the liquid bag 13 that does not contain any ink. The extension portion 134 is provided at the second edge 132 of the liquid bag 13 and extends toward the rear from the liquid-holding portion 133. An insertion portion 76 of the spout 7 is inserted between the sheets 13A and 13B in the first edge 131. A curved region 146 is provided in the first edge 131. The curved region 146 is formed by curving the sheets 13A and 13B around the insertion portion 76 in the direction (the up-down direction) in which the sheets 13A and 13B are separated from each other. The curved region 146 extends to the rear of the insertion portion 76.

The spout 7 has a circular cylindrical shape that extends in the front-rear direction. The spout 7 is connected to the first edge 131 of the liquid bag 13. The rubber plug is disposed in the interior of the spout 7 and seals the spout 7 such that the ink inside the liquid-holding portion 133 does not leak out. The insertion portion 76 is provided in the rear end of the spout 7. The insertion portion 76 has a circular cylindrical shape that extends in the front-rear direction. The sheets 13A and 13B are thermally welded to the insertion portion 76.

[Case 32]

Figure 2:
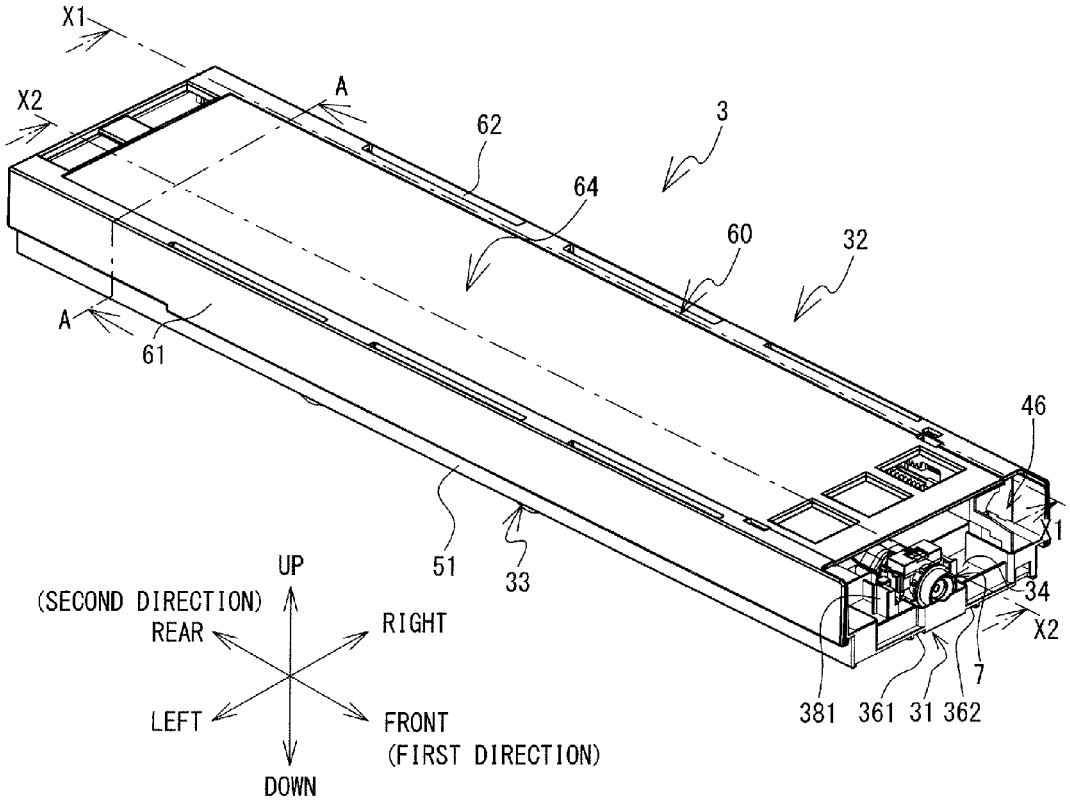
FIG. 2 is an oblique view of a cartridge case in which a second case is in a closed position, as seen from above.

As shown in FIGS. 2 and 3, the case 32 has a box shape with its long axis extending in the front-rear direction. The case 32 includes a first case 33, a second case 60, a roll-up member 43, an elastic member 45, a detection portion 46 (refer to FIG. 5), a switching member 205 (refer to FIG. 5), and the like. The first case 33 supports the liquid container 31. The second case 60 is disposed on the top side of the first case 33. The second case 60 can slide in the front-rear direction in relation to the first case 33. The position in which the second case 60 has been slid toward the front and the top of the first case 33 is closed, as shown in FIG. 2, is called the closed position. The position in which the second case 60 has been slid toward the rear and the top of the first case 33 is open, as shown in FIG. 3, is called the open position.

[First Case 33]

Figure 5:
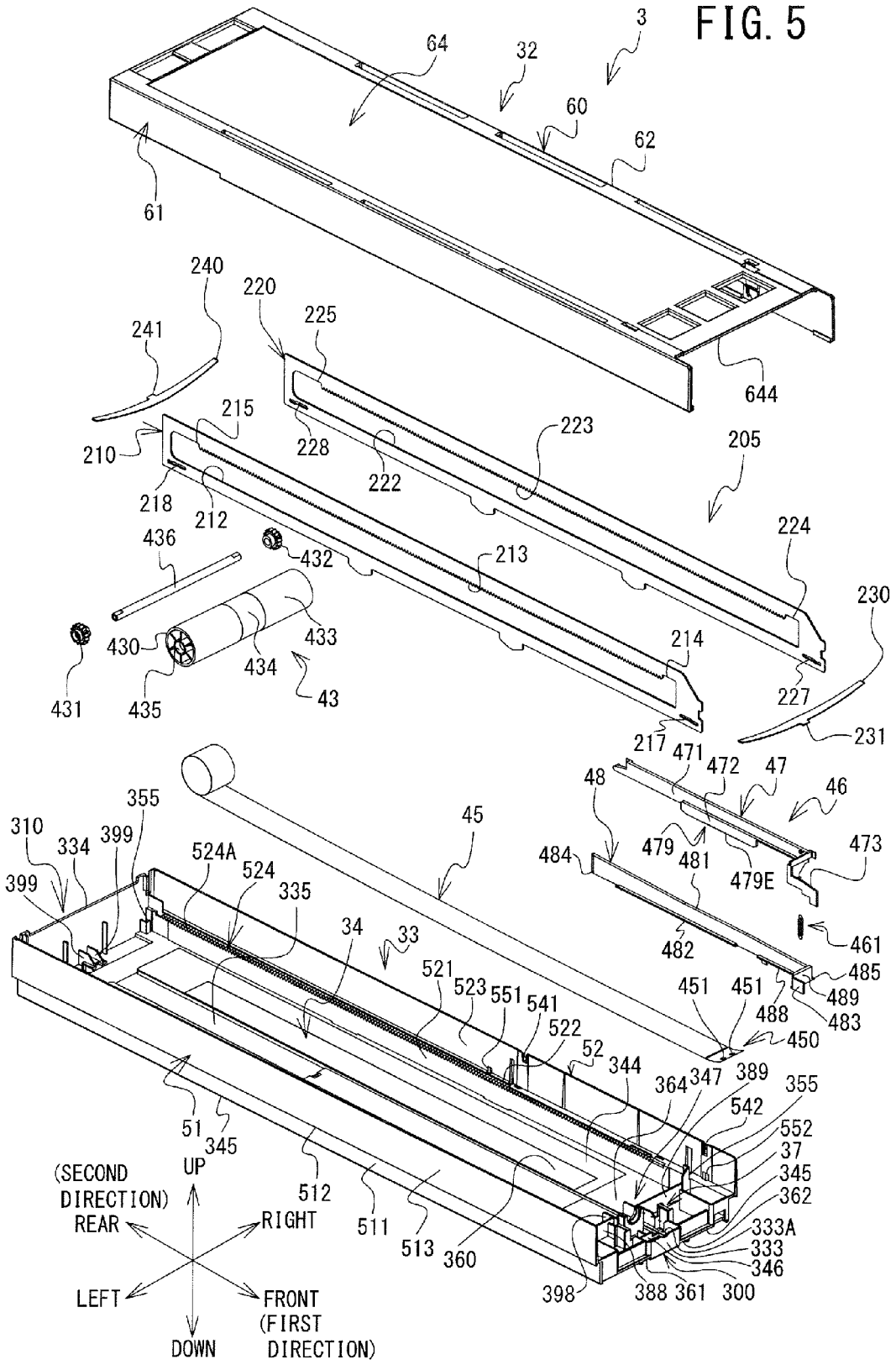
FIG. 5 is an exploded oblique view of a case.

As shown in FIG. 5, the first case 33 includes a support wall portion 34, a spout support portion 37, a pair of side walls 51, 52, a front wall portion 333, a rear wall portion 334, and the like. The support wall portion 34 is a wall portion that extends in the front-rear direction and the left-right direction. The support wall portion 34 is rectangular with its long axis extending in the front-rear direction. The top face of the support wall portion 34 is called the first inner face 344. The first inner face 344 extends in the front-rear direction and the left-right direction. The first direction and the second direction are aligned to the front-rear direction, in which the first inner face 344 is longer than in the left-right direction. The first direction is the forward direction, toward the spout support portion 37. The second direction is the rearward direction, away from the spout support portion 37. The bottom face of the support wall portion 34 is called the first outer face 345. The pair of the side walls 51 and 52 respectively extend upward from the left side and the right side of the support wall portion 34. The side wall 51 is a side wall on the left side of the first case 33. The side wall 52 is a side wall on the right side of the first case 33. The rear wall portion 334 extends upward on a rear edge portion 310 of the support wall portion 34. The rear wall portion 334 is a side wall on the rear side of the first case 33.

Figure 7:
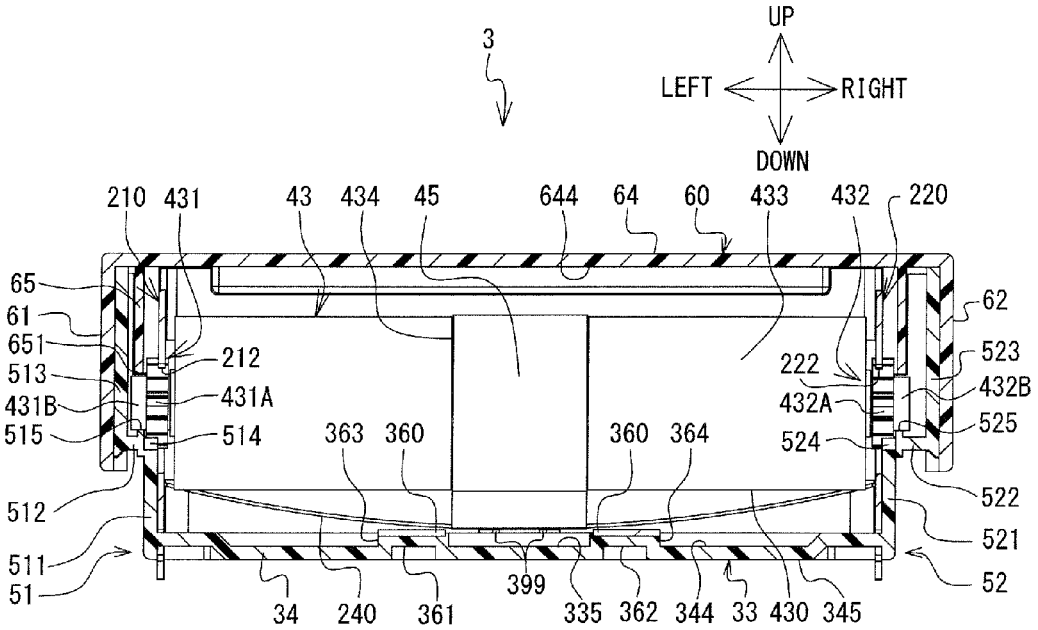
FIG. 7 is a section view, as seen from the direction of arrows along a line A-A in FIG. 2.
Figure 8:
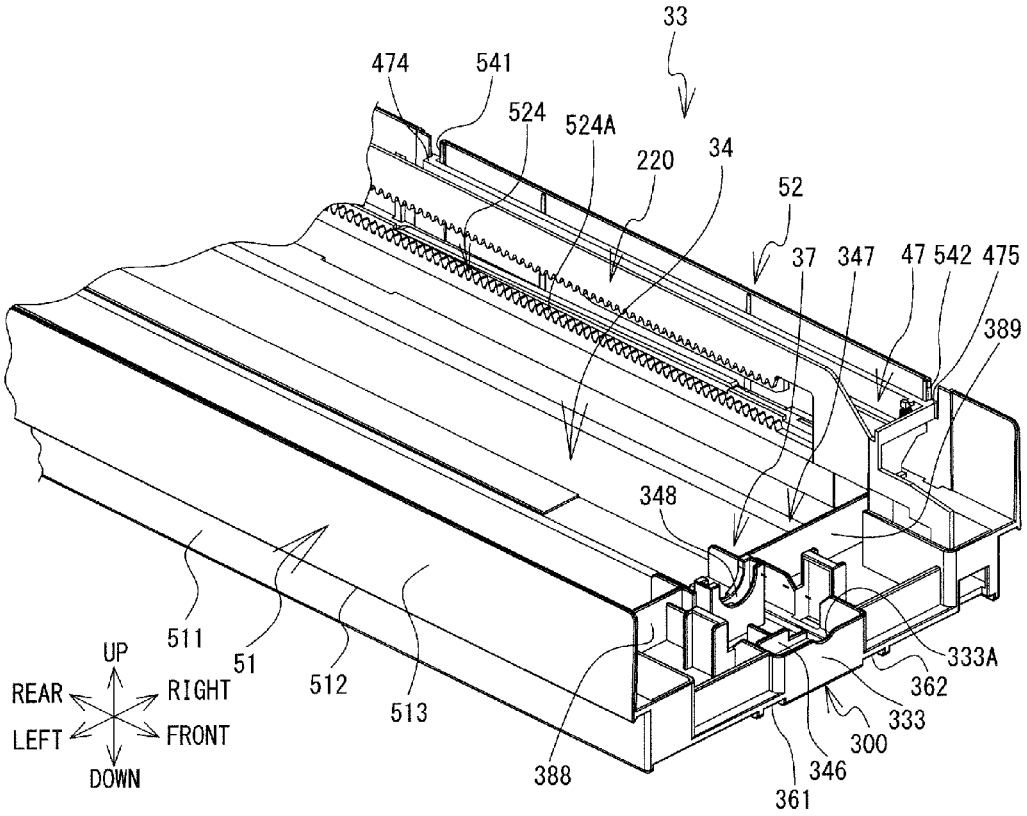
FIG. 8 is an oblique view of a front end of a first case.

As shown in FIGS. 5, 7, and 8, the side wall 51 on the left side includes a first section 511, a second section 512, a third section 513, and a lower support portion 514. The first section 511 is a wall portion that extends upward from the left edge of the first inner face 344. The first section 511 constitutes a lower side part of the side wall 51. The second section 512 is a section that projects to the left from the top edge of the first section 511. The third section 513 is a wall portion that extends upward from the left edge of the second section 512. The third section 513 constitutes an upper side part of the side wall 51. The lower support portion 514 is positioned on the right edge of the second section 512.

The side wall 52 on the right side includes a first section 521, a second section 522, a third section 523, and a lower support portion 524. The first section 521 is a wall portion that extends upward from the right edge of the first inner face 344. The first section 521 constitutes a lower side part of the side wall 52. The second section 522 is a section that projects to the right from the top edge of the first section 521. The third section 523 is a wall portion that extends upward from the right edge of the second section 522. The third section 523 constitutes an upper side part of the side wall 52. A restriction wall (not shown in the drawings) on the rear end of the second section 522 projects upward from the second section 522. The second section 522 is provided with the lower support portion 524 on its left edge. The lower support portion 524 is positioned on the left edge of the second section 522.

The lower support portions 514 and 524 each extend from slightly in front of the rear wall portion 334 to slightly to the rear of the spout support portion 37.

As shown in FIG. 8, the front wall portion 333 is rectangular in a front view. The front wall portion 333 is provided on a front end portion 300 of the support wall portion 34. The front wall portion 333 extends upward from the center in the left-right direction of the front end of the first inner face 344 to substantially the same height as the upper edges of the first sections 511 and 521. A recessed portion 333A is formed in the center in the left-right direction of the front wall portion 333. The recessed portion 333A is a portion that is recessed downward in a circular arc shape from the upper edge of the front wall portion 333.

Figure 6:
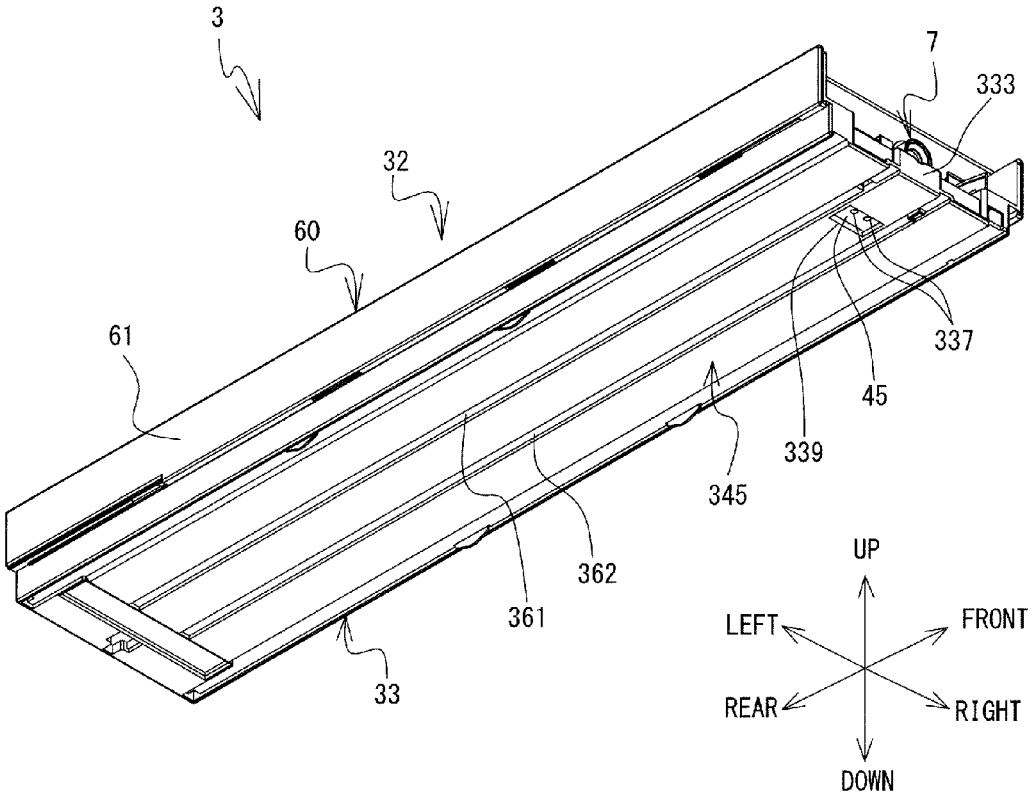
FIG. 6 is an oblique view of the cartridge case in which the second case is in the closed position, as seen from below.

As shown in FIG. 6, two grooves 361 and 362 are recessed upward in the first outer face 345. The groove 361 is provided in the left side of the front wall portion 333. The groove 362 is provided in the right side of the front wall portion 333. The grooves 361 and 362 extend from the front end portion 300 of the support wall portion 34 to slightly in front of the rear edge portion 310. Projecting portions 363 and 364 are located in the first inner face 344 on the upper sides of the grooves 361 and 362, respectively (refer to FIG. 7). The projecting portions 363 and 364 each extend in the front-rear direction while projecting upward. Anti-slip members 360 are plate-shaped pieces of rubber. The anti-slip members 360 are affixed to the top faces of the projecting portions 363 and 364.

As shown in FIGS. 5 and 8, the spout support portion 37 is provided on the front end of the support wall portion 34. The spout support portion 37 supports the spout 7. The spout support portion 37 includes a first support portion 346 and a second support portion 347. The first support portion 346 is provided to the rear of the front wall portion 333. The first support portion 346 is a plate-shaped member that is T-shaped in a plan view. The first support portion 346 projects upward from the first inner face 344. The second support portion 347 is provided to the rear of the first support portion 346, between the two grooves 361 and 362. The second support portion 347 is a wall portion that extends in the left-right direction. The second support portion 347 extends upward from the support wall portion 34. A recessed portion 348 is a portion that is recessed downward from the upper edge of the second support portion 347 in a substantially semicircular shape. In a front view, the recessed portion 348 is positioned slightly higher than the recessed portion 333A.

As shown in FIGS. 5 and 7, a case recessed portion 335 is a portion that is recessed downward between the projecting portions 363 and 364. The case recessed portion 335 extends from the rear side of the spout support portion 37 to the front side of the rear edge portion 310 of the support wall portion 34. As shown in FIG. 6, a mount opening 339 is provided in the case recessed portion 335 on the rear side of the spout support portion 37 (refer to FIGS. 5 and 8). The mount opening 339 is an opening that extends through the support wall portion 34 in the up-down direction. A mount plate (not shown in the drawings) is provided slightly above the mount opening 339 and is provided with two lugs 337. The two lugs 337 are arrayed in the left-right direction and project downward from the mount plate. In a bottom view, the two lugs 337 are exposed through the mount opening 339.

As shown in FIGS. 5 and 8, anchor walls 388 and 389 are respectively provided on the left and right sides of the second support portion 347. The anchor wall 388 extends upward from the first inner face 344 and extends in the left-right direction between the second support portion 347 and the first section 511. The anchor wall 389 extends upward from the first inner face 344 and extends in the left-right direction between the second support portion 347 and the first section 521. Holding portions 398 are provided on the anchor walls 388 and 389. The holding portions 398 are a pair of plate-shaped bodies that extend toward the rear from the right end of the anchor wall 388 and the left end of the anchor wall 389. An energizing member 230, which will be described below, is affixed to the holding portions 398. As shown in FIG. 5, holding portions 399 are provided on the rear wall portion 334. The holding portions 399 are a pair of plate-shaped bodies that project toward the front from a central portion in the left-right direction of the rear wall portion 334. An energizing member 240, which will be described below, is affixed to the holding portions 399.

As shown in FIG. 5, a slit 355 is provided in the upper part of the right edge of the anchor wall 389. Another slit 355 is provided on the left side of the rear end of the first section 521. These slits 355 support the front and rear edges of a presser plate 220 such that the presser plate 220 can move up and down. A slit is provided in the upper part of the left edge of the anchor wall 388, although not shown in the drawings. Another slit is provided on the right side of the rear end of the first section 511. These slits support the front and rear edges of a presser plate 210 such that the presser plate 210 can move up and down.

[Switching Member 205]

As shown in FIG. 5, the switching member 205 includes the presser plates 210, 220 and the energizing members 230, 240. The presser plate 210 is a frame-shaped plate that extends in the up-down direction and the front-rear direction. The length of the presser plate 210 in the up-down direction is slightly less than the length of the side wall 51 in the up-down direction. The length of the presser plate 210 in the front-rear direction is substantially equal to the length from the rear wall portion 334 to the anchor wall 388 in the front-rear direction. The presser plate 210 includes a slide opening 212, an upper support portion 213, a retraction portion 214, and a retraction portion 215.

In a side view, the slide opening 212 is provided on the inner side of the presser plate 210 and is a substantially rectangular opening whose long axis extends in the front-rear direction. The slide opening 212 extends through the presser plate 210 in the left-right direction. The slide opening 212 extends from the rear end to the front end of the presser plate 210. The upper edge and the lower edge of the slide opening 212 are substantially parallel and are opposed to each other in the up-down direction. The retraction portions 214 and 215 are located at the front end and the rear end of the slide opening 212. The upper support portion 213 is a portion provided over the entire upper edge of the slide opening 212, except for the retraction portions 214 and 215.

The upper support portion 213 is a rack gear on which a plurality of teeth facing downward are arrayed continuously in the front-rear direction. The length from the lower edge of the slide opening 212 to the upper support portion 213 in the up-down direction is slightly greater than a diameter D1 of a rotary gear 431A of a shaft support portion 431 (refer to FIG. 9A). The upper edge of the slide opening 212 in the retraction portions 214 and 215 is higher than the upper support portion 213. The up-down length and the front-rear length of the slide opening 212 in the retraction portions 214 and 215 are both slightly greater than the diameter D1 of the rotary gear 431A. The rotary gear 431A of the shaft support portion 431 passes through the inner side of the slide opening 212. The rotary gear 431A rotates while meshing with the rack gear of the lower support portion 514. The shaft support portion 431 can therefore move in the front-rear direction within the slide opening 212.

The presser plate 220 is identical to the presser plate 210. The presser plate 220 includes a slide opening 222, an upper support portion 223, a retraction portion 224, and a retraction portion 225. A rotary gear 432A of a shaft support portion 432 passes through the inner side of the slide opening 222. The rotary gear 432A rotates while meshing with the rack gear of the lower support portion 524. The shaft support portion 432 can therefore move in the front-rear direction within the slide opening 222.

The presser plates 210 and 220 are attached to the first case 33 by the energizing members 230 and 240. The energizing members 230 and 240 are identical flat springs that extend in the left-right direction. The energizing members 230 and 240 are respectively attached to the holding portions 398 and 399. An anchoring nub 231 is provided in the center of the energizing member 230 and projects toward the front. An anchoring nub 241 is provided in the center of the energizing member 240 and projects toward the rear.

As shown in FIGS. 5 and 7, the presser plate 210 is disposed along the right face of the first section 511, between the rear wall portion 334 and the anchor wall 388. The presser plate 220 is disposed along the left face of the first section 521, between the rear wall portion 334 and the anchor wall 389. Therefore, the presser plates 210 and 220 are respectively arranged side by side with the first sections 511 and 521 in the left-right direction.

The holding portion 398 is anchored by the anchoring nub 231, thus preventing the energizing member 230 from shifting in the left-right direction. The energizing member 230 is prevented from shifting in the front-rear direction because the energizing member 230 is positioned by an anchor member (not shown in the drawings). Anchor holes 217 and 227 are respectively provided in the presser plates 210 and 220. The left and right ends of the energizing member 230 are respectively inserted into the anchor holes 217 and 227.

The holding portion 399 is anchored by the anchoring nub 241, thus preventing the energizing member 240 from shifting in the left-right direction. The energizing member 240 is prevented from shifting in the front-rear direction because the energizing member 240 is positioned by an anchor member (not shown in the drawings). Anchor holes 218 and 228 are respectively provided in the presser plates 210 and 220. The left and right ends of the energizing member 240 are respectively inserted into the anchor holes 218 and 228.

[Roll-Up Member 43]

As shown in FIGS. 5 and 7, the roll-up member 43 includes a shaft body 430, shaft support portions 431, 432, and a coupling shaft 436. The shaft body 430 has a circular cylindrical shape that extends in the left-right direction. The shaft body 430 includes an outer circumferential face 433, a shaft recessed portion 434, and a shaft hole 435. The outer circumferential face 433 may have an anti-slip function. For example, the outer circumferential face 433 may be covered with an anti-slip resin sheet, an anti-slip surface treatment may be performed on the outer circumferential face 433, and the shaft body 430 itself may be an elastic member such as rubber. It is acceptable for the outer circumferential face 433 not to have an anti-slip function.

The shaft recessed portion 434 is provided in the center in the left-right direction of the outer circumferential face 433. The shaft recessed portion 434 has a groove shape that is recessed slightly toward the inside of the shaft body 430 from the outer circumferential face 433. The shaft hole 435 is a hole that passes in the left-right direction through the cross-sectional center (the rotational center) of the shaft body 430. Both ends of the coupling shaft 436, which is inserted into the shaft hole 435, protrude from the shaft hole 435 on the left and right sides. The shaft body 430 can rotate around the coupling shaft 436 inserted into the shaft hole 435. For example, the coupling shaft 436 is simply inserted into the shaft body 430 without being affixed to the shaft body 430, so that the shaft body 430 rotates in relation to the coupling shaft 436.

Figure 9A:
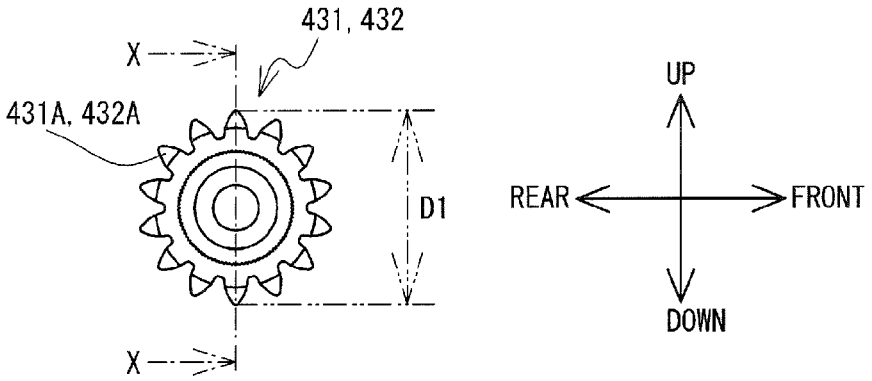
FIG. 9A is a front view of shaft support portions.
Figure 9B:
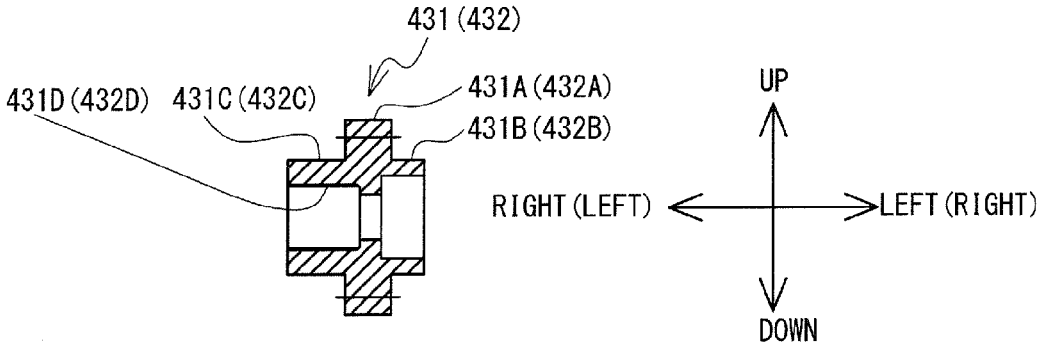
FIG. 9B is a section view, as seen from the direction of arrows along a line X-X in FIG. 9A.

The shaft support portions 431 and 432 are respectively disposed on the left and right ends of the shaft body 430. As shown in FIGS. 9A and 9B, the shaft support portions 431 and 432 are substantially coaxial with the center of rotation of the shaft body 430. The shaft support portion 431 includes the rotary gear 431A, a shaft portion 431B, and a shaft portion 431C. The rotary gear 431A is a disc-shaped gear around the circumference of which a plurality of teeth are formed. The rotary gear 431A may be a pinion gear, for example. The rotary gear 431A meshes with the lower support portion 514 and with the upper support portion 213 of the presser plate 210. A coupling hole 431D is provided in the rotational center of the rotary gear 431A. The coupling shaft 436 is affixed to the shaft support portion 431 by inserting the left end of the coupling shaft 436 into the coupling hole 431D. The shaft portion 431B is a circular cylinder whose diameter is smaller than that of the rotary gear 431A. The shaft portion 431B projects to the left from the rotary gear 431A. The shaft portion 431C is a circular cylinder whose diameter is smaller than that of the rotary gear 431A. The shaft portion 431C projects to the right from the rotary gear 431A.

In the same manner, the shaft support portion 432 includes the rotary gear 432A, a shaft portion 432B, and a shaft portion 432C. The rotary gear 432A is a disc-shaped gear around the circumference of which a plurality of teeth are formed. The rotary gear 432A may be a pinion gear, for example. The rotary gear 432A meshes with the lower support portion 524 and with the upper support portion 223 of the presser plate 220. A coupling hole 432D is provided in the rotational center of the rotary gear 432A. The coupling shaft 436 is affixed to the shaft support portion 432 by inserting the right end of the coupling shaft 436 into the coupling hole 432D. The shaft portion 432B is a circular cylinder whose diameter is smaller than that of the rotary gear 432A. The shaft portion 432B projects to the right from the rotary gear 432A. The shaft portion 432C is a circular cylinder whose diameter is smaller than that of the rotary gear 432A. The shaft portion 432C projects to the left from the rotary gear 432A.

The outer circumferential shape of each one of the shaft portions 431B and 432B in vertical cross section may be circular, for example. The shaft portions 431B and 432B may each be provided with second ridge-and-groove sets. Although the outer circumferential shape of each one of the shaft portions 431B and 432B in vertical cross section is substantially circular, the outer circumferential shape will be explained as being circular. The shape of each one of the shaft portions 431B and 432B need only be a shape that can roll. Therefore, the outer circumferential shape of each one of the shaft portions 431B and 432B in vertical cross section may be elliptical. The outer circumferential shape of each one of the shaft portions 431C and 432C in vertical cross section may be circular, for example. The outer circumferential shape of each one of the shaft portions 431C and 432C in vertical cross section may be elliptical. It is acceptable for the shaft portion 432B to be provided with the second ridge-and-groove sets and for the shaft portion 431B not to be provided with the second ridge-and-groove sets. It is acceptable for the outer circumferential shape of the shaft portion 431B in vertical cross section not to be the same as the outer circumferential shape of the shaft portion 432B in vertical cross section.

As shown in FIG. 7, the shaft body 430 is disposed inside the first case 33, between the presser plates 210 and 220. The lower support portion 514 is exposed on the right side through the slide opening 212. The shaft support portion 431 projects leftward from the left end of the shaft body 430 toward the side wall 51 and is inserted into the slide opening 212 from the right side. The rotary gear 431A is disposed inside the slide opening 212 and meshes with the lower support portion 514. A rib 515 is provided on the top face of the second section 512 and extends in the front-rear direction. The shaft portion 431B is disposed on the top side of the rib 515.

In the same manner, the lower support portion 524 is exposed on the left side through the slide opening 222. The shaft support portion 432 projects rightward from the right end of the shaft body 430 toward the side wall 52 and is inserted into the slide opening 222 from the left side. The rotary gear 432A is disposed inside the slide opening 222 and meshes with the lower support portion 524. A rib 525 is provided on the top face of the second section 522 and extends in the front-rear direction. The shaft portion 432B is disposed on the top side of the rib 525. The roll-up member 43 is supported from below by the ribs 515 and 525 in a state in which the outer circumferential face 433 is slightly higher than the first inner face 344. The rotary gears 431A and 432A respectively mesh with the lower support portions 514 and 524 in a state in which there are small backlashes. Therefore, the rotary gears 431A and 432A can rotate smoothly in conjunction with the movement of the roll-up member 43.

[Elastic Member 45]

As shown in FIGS. 3 and 5, the elastic member 45 is a flat spring with one of a fixed load and a variable load. The elastic member 45 is disposed on the inner side of the case recessed portion 335. Two round holes 451 are arrayed in the left-right direction in a front end portion 450 of the elastic member 45. When the elastic member 45 is placed into the case recessed portion 335, the front end portion 450 of the elastic member 45 is inserted from the rear into the gap between the mount plate (not shown in the drawings) and the mount opening 339 (refer to FIG. 6). The front end portion 450 of the elastic member 45 is anchored to the mount opening 339 by engaging the two lugs 337 in the two round holes 451 (refer to FIG. 6). The elastic member 45 extends toward the rear from the mount plate and is wound around the shaft recessed portion 434 of the roll-up member 43. Because the elastic member 45 generates a restorative force toward the front, the elastic member 45 energizes the roll-up member 43 toward the front through the shaft body 430.

[Second Case 60]

As shown in FIGS. 5 and 7, the second case 60 includes an upper wall portion 64 and a pair of side walls 61 and 62. The upper wall portion 64 is a wall portion that extends in the front-rear direction and the left-right direction. The upper wall portion 64 is rectangular with its long axis extending in the front-rear direction.

[Detection Portion 46]

As shown in FIG. 5, the detection portion 46 includes a first side plate 47, a second side plate 48, and a coil spring 461. The first side plate 47 and the second side plate 48 are disposed on the front end side of the case 33, on the right side, which is one of two sides in an orthogonal direction. The first side plate 47 and the second side plate 48 extend in the front-rear direction. The orthogonal direction is a direction (the left-right direction) parallel to the first inner face 344 and orthogonal to the front-rear direction. The first side plate 47 is disposed above the second side plate 48. The coil spring 461 engages with the first side plate 47 and the second side plate 48. The coil spring 461 energizes the first side plate 47 and the second side plate 48, as will be described below.

[First Side Plate 47]

Figure 10A:
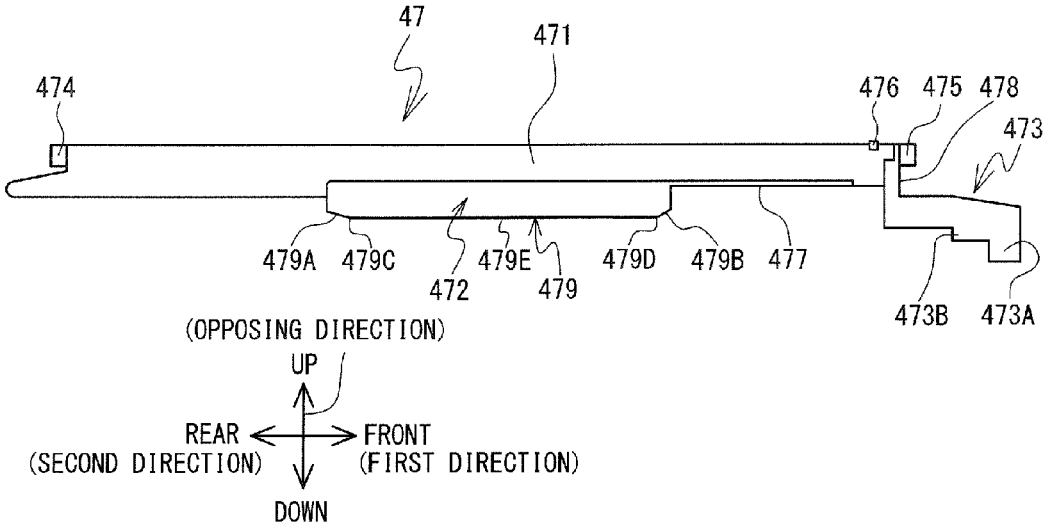
FIG. 10A is a left side view of a first side plate portion.
Figure 10B:
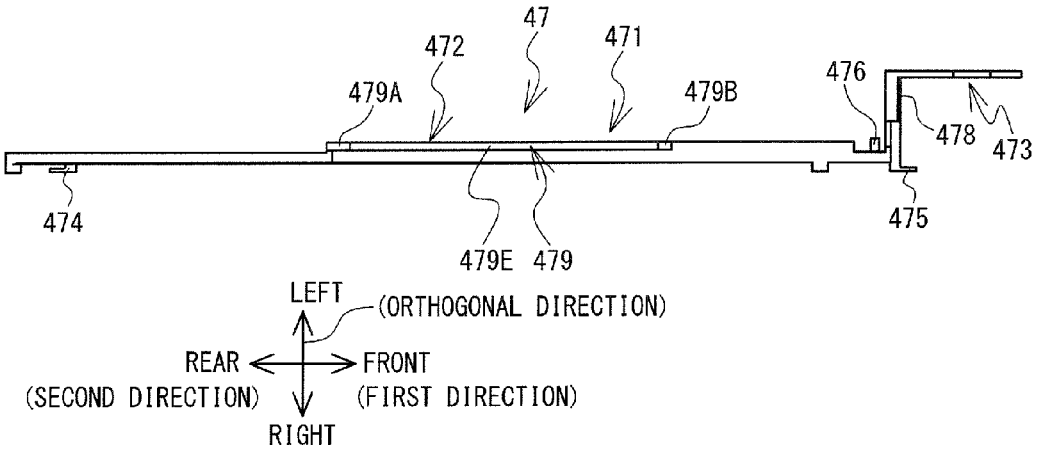
FIG. 10B is a bottom view of the first side plate portion.

As shown in FIGS. 10A and 10B, the first side plate 47 includes a first arm portion 471, a first contact portion 472, a first indicator portion 473, first side plate engaging portions 474, 475, and a first spring mount portion 476. The first indicator portion 473 is disposed on the front end of the first side plate 47. The first arm portion 471 has a plate shape that extends toward the front. The first arm portion 471 is disposed to the rear of the first indicator portion 473. A cutaway portion 477 is provided on the front end of the first arm portion 471. The cutaway portion 477 is a portion where the bottom edge of the first arm portion 471 is recessed upward.

The first contact portion 472 projects toward the left from a portion of the bottom of the first arm portion 471. The first contact portion 472 can contact the outer circumferential face of the shaft portion 431B of the shaft support portion 431 (refer to FIG. 9B). The first contact portion 472 is a plate that is long in the front-rear direction in a left side view. The first contact portion 472 extends parallel to the first arm portion 471. The first contact portion 472 projects to the left and downward from the bottom edge of the first arm portion 471, at the rear of the cutaway portion 477. The first contact portion 472 extends toward the front from a point that is slightly toward the front from the rear end of the first arm portion 471. The front end of the first contact portion 472 is disposed slightly toward the front from the center in the front-rear direction of a second arm portion 481 of the second side plate 48 (refer to FIG. 5). A bottom face 479 of the first contact portion 472 is a face that extends in the front-rear direction. An inclined face 479A is a flat face provided on the rear end of the bottom face 479. An inclined face 479B is provided on the front end of the bottom face 479. The outer circumferential face of the shaft portion 431B of the shaft support portion 431 can contact the bottom face 479.

Figure 11:
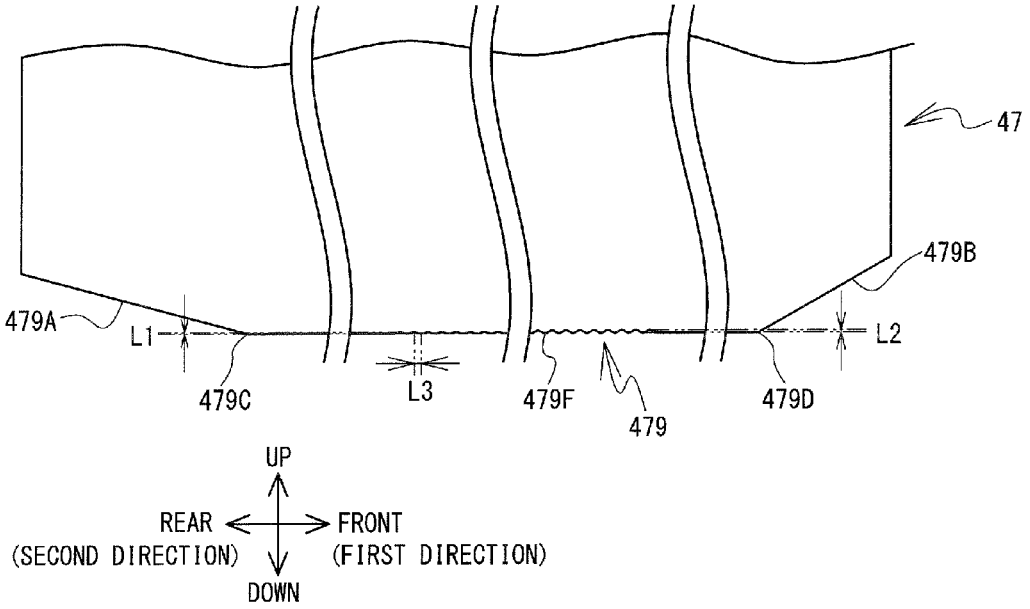
FIG. 11 is an enlarged partial view of the first side plate portion.

A resistance portion 479E is positioned between a rear edge 479C and a front edge 479D of the bottom face 479. As shown in FIG. 11, the resistance portion 479E may be first ridge-and-groove sets 479F, for example. For example, the ridges and grooves of the first ridge-and-groove sets 479F may extend in the left-right direction. If the height of the ridge on the rear edge 479C end is L1, the height of the ridge on the front edge 479D end is L2, and the pitch between ridges is L3, L2 may be greater than L1 and the heights of the ridges may increase from the rear edge 479C end to the front edge 479D end, for example. The height of the ridge, which defines the size of the ridge-and-groove set, is defined as the distance in the up-down direction between the top of the ridge and the bottom of the groove in each of the first ridge-and-groove sets 479F. The pitch is defined as the distance in the front-rear direction between the ridges of two adjacent first ridge-and-groove sets 479F. In the current example, the sliding resistance of the resistance portion 479E increases from the rear edge 479C to the front edge 479D of the bottom face 479. Therefore, when the outer circumferential face of the shaft portion 431B of the shaft support portion 431 moves from the rear edge 479C to the front edge 479D of the bottom face 479, the sliding resistance increases from the rear edge 479C to the front edge 479D. For example, L1 may be 0.03 millimeters, L2 may be 0.06 millimeters, L3 may be 0.3 millimeters. It is preferable for the pitch L3 to be from 0.1 millimeters to 2 millimeters. It is preferable for the ridge heights L1 and L2 to be from 0.01 millimeters to 0.2 millimeters. The dimensions of the first ridge-and-groove sets 479F of the resistance portion 479E may be set based on the energizing force of the elastic member 45, the rigidity of the liquid container 31, and the cross-sectional surface area of the liquid container 31 in the left-right direction.

The second ridge-and-groove sets may be provided on the outer circumferential face of the shaft portion 431B of the shaft support portion 431 (refer to FIG. 9B), in order for the second ridge-and-groove sets to contact the first ridge-and-groove sets 479F and thus further increase the sliding resistance to the forward movement of the roll-up member 43. It is preferable for the pitch of the second ridge-and-groove sets to be from 0.1 millimeters to 2 millimeters. It is preferable for the pitch of the second ridge-and-groove sets on the outer circumferential face of the shaft portion 431B to be the same as that of the first ridge-and-groove sets 479F. For example, the pitch may be 0.3 millimeters. It is preferable for the ridge heights of the second ridge-and-groove sets to be from 0.01 millimeters to 0.2 millimeters.

As shown in FIGS. 10A and 10B, a wall portion 478 is connected to the front end of the first arm portion 471 and extends to the left. The plate-shaped first indicator portion 473 extends toward the front from the lower part of the left edge of the wall portion 478. The first indicator portion 473 is disposed to the left from the first arm portion 471. The first indicator portion 473 includes a first projecting portion 473A and a second projecting portion 473B. The first projecting portion 473A projects downward from the first direction tip of the first indicator portion 473. The second projecting portion 473B projects downward on the rear side of the first projecting portion 473A. The bottom edge of the second projecting portion 473B is positioned higher than the bottom edge of the first projecting portion 473A.

The first side plate engaging portions 474 and 475 engage with first support openings 541 and 542, respectively. The first side plate engaging portion 475 is separated forward from the first side plate engaging portion 474. As shown in FIGS. 5 and 8, the first support openings 541 and 542 are slits formed in the side wall 52 of the first case 33. The first side plate engaging portion 474 is provided on the upper portion of the rear end of the first arm portion 471. The first side plate engaging portion 474 projects toward the right from the first arm portion 471, and the right edge of the first side plate engaging portion 474 extends toward the rear. The first side plate engaging portion 475 is provided on the upper portion of the front end of the first arm portion 471. The first side plate engaging portion 475 projects toward the right from the first arm portion 471, and the right edge of the first side plate engaging portion 475 extends toward the front.

The first spring mount portion 476 is provided on the rear of the first side plate engaging portion 475. The first spring mount portion 476 projects toward the left from the top edge of the first arm portion 471, and the left edge of the first spring mount portion 476 extends upward. The upper end of the coil spring 461 (refer to FIG. 5) is mounted on the first spring mount portion 476.

[Second Side Plate 48]

As shown in FIG. 5, the second side plate 48 includes the second arm portion 481, a second contact portion 482, a second indicator portion 483, second side plate engaging portions 484, 485, a second spring mount portion (not shown in the drawings), and a projecting portion 488. The second indicator portion 483 is provided on the front end of the second side plate 48. The plate-shaped second arm portion 481 extends toward the front. The second arm portion 481 is provided to the rear of the second indicator portion 483. The second arm portion 481 is longer in the front-rear direction than the first arm portion 471 of the first side plate 47.

The second contact portion 482 projects toward the left from a portion of the second arm portion 481. The outer circumferential face of the shaft portion 431B of the shaft support portion 431 (refer to FIG. 9) can contact the second contact portion 482. The second contact portion 482 projects to the left from the bottom edge of the second arm portion 481. The second contact portion 482 extends toward the front from a point that is slightly toward the front from the rear end of the second arm portion 481. The front end of the second contact portion 482 is provided slightly toward the front from the center in the front-rear direction of the second arm portion 481. The projecting portion 488 is provided on the bottom edge of the second arm portion 481, toward the front from the second contact portion 482. The projecting portion 488 is separated forward from the second contact portion 482.

A wall portion 489 is connected to the front end of the second arm portion 481 and extends to the left. The plate-shaped second indicator portion 483 extends toward the front from the left edge of the wall portion 489. The second indicator portion 483 is provided to the left from the second arm portion 481. The second indicator portion 483 is rectangular in a left side view.

The second side plate engaging portions 484 and 485 engage with second support openings 551 and 552, respectively. The second side plate engaging portion 485 is separated forward from the second side plate engaging portion 484. The second support openings 551 and 552 are openings formed in the side wall 52 of the first case 33. The second side plate engaging portion 484 is provided on the lower edge of the rear end of the second arm portion 481 and projects toward the right from second arm portion 481. The second side plate engaging portion 485 is provided on the lower edge of the front end of the second arm portion 481 and projects toward the right from second arm portion 481.

The second spring mount portion (not shown in the drawings) is provided to the rear of the second side plate engaging portion 485. The second spring mount portion projects toward the left from the bottom edge of the second arm portion 481, and the left edge of the second spring mount portion extends downward. The lower end of the coil spring 461 is mounted on the second spring mount portion. As shown in FIG. 5, the coil spring 461 extends in the up-down direction. The upper end of the coil spring 461 is a circular ring that can be mounted on the first spring mount portion 476. The lower end of the coil spring 461 is a circular ring that can be mounted on the second spring mount portion.

[Structure of First Case 33 that Supports the First Side Plate 47 and the Second Side Plate 48]

As shown in FIG. 8, the distance between the first support openings 541 and 542 corresponds to the distance between the first side plate engaging portions 474 and 475 of the first side plate 47 (refer to FIGS. 10A and 10B). The first support openings 541 and 542 are slits that extend in the up-down direction. Hook portions at the tips of the first side plate engaging portions 474 and 475 extend parallel to the first arm portion 471. The hook portions engage with the side wall 52 on the outer side of the first support openings 541 and 542. The first support openings 541 and 542 guide the first side plate engaging portions 474 and 475, respectively, in the up-down direction. The first support openings 541 and 542 support the first side plate 47 such that the first indicator portion 473 (refer to FIGS. 10A and 10B) can move in the up-down direction.

The distance between the second support openings 551 and 552 corresponds to the distance between the second side plate engaging portions 484 and 485 of the second side plate 48. The second support openings 551 and 552 support the second side plate 48 such that the second indicator portion 483 can move in the up-down direction.

The first side plate engaging portions 474 and 475 are disposed in the first support openings 541 and 542. The second side plate engaging portions 484 and 485 are disposed in the second support openings 551 and 552. In this arrangement, the coil spring 461 is mounted on the first spring mount portion 476 (refer to FIG. 10A) and the second spring mount portion (not shown in the drawings) in a state in which the coil spring 461 is stretched in the up-down direction. The restorative force of the coil spring 461 energizes the first spring mount portion 476 downward and energizes the second spring mount portion upward.

Figure 12A:
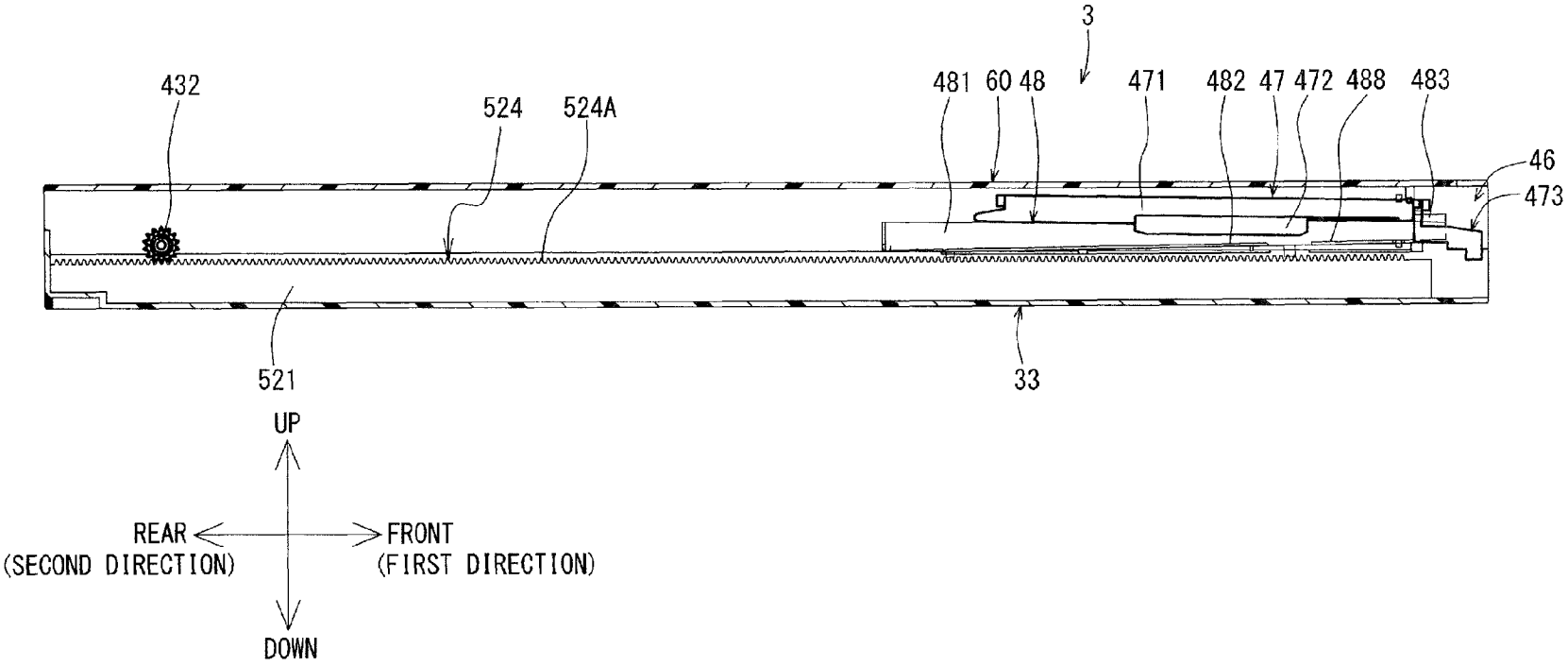
FIG. 12A is a section view of the cartridge case in a first state, in which the unused liquid container is mounted, as seen from the direction of arrows along a line X1-X1 in FIG. 2.

As shown in FIG. 8, the top face of the lower support portion 524 is a rack 524A. The rack 524A is a rolling surface on which the shaft support portion 432 of the roll-up member 43 (refer to FIG. 9B) rolls. The rack 524A extends toward the front. As shown in FIG. 12A, the first contact portion 472 and the second contact portion 482 are disposed obliquely in relation to the rack 524A. For example, the first contact portion 472 may be disposed such that the first contact portion 472 becomes lower toward the front. For example, the second contact portion 482 may be disposed such that the second contact portion 482 becomes higher toward the front. For example, the bottom face of the first support opening 542 may be lower than the bottom face of the first support opening 541, and the coil spring 461 may energize the first spring mount portion 476 downward and energize the second spring mount portion upward.

In the arrangement in which the first side plate 47 and the second side plate 48 are engaged with the side wall 52, the first side plate 47 and the second side plate 48 are disposed on the left side of the side wall 52. The first support opening 541 is positioned higher than the second support opening 551. The first support opening 542 is positioned higher than the second support opening 552. Therefore, the first arm portion 471 of the first side plate 47 is positioned higher than the second arm portion 481 of the second side plate 48. In this arrangement, the first contact portion 472 is positioned to the left of the first arm portion 471 and the second arm portion 481, and the bottom face 479 of the first contact portion 472 is positioned above the second contact portion 482 such that the bottom face 479 is opposed to the top face of the second contact portion 482. Therefore, the bottom face 479 of the first contact portion 472 and the top face of the second contact portion 482 contact the outer circumferential face of the shaft portion 431B of the shaft support portion 432 that moves toward the front.

As will be described below, the printer 1 can display the amount of the remaining ink by detecting the positions of the first indicator portion 473 and the second indicator portion 483, which move in the up-down direction in accordance with the amount of the remaining ink. The first indicator portion 473 moves between a lower position (refer to FIGS. 12A and 13A) and an upper position (refer to FIGS. 14A and 15A). The second indicator portion 483 moves between a lower position (refer to FIGS. 13A and 14A) and an upper position (refer to FIGS. 12A and 15A). The combination of the positions of the first indicator portion 473 and the second indicator portion 483 is changed from a first state to a fourth state, as shown in FIGS. 12 to 15. The printer 1 includes a first optical detection portion (not shown in the drawings) and a second optical detection portion (not shown in the drawings). The first optical detection portion includes a first light emitting portion (not shown in the drawings) and a first light receiving portion (not shown in the drawings). The second optical detection portion includes a second light emitting portion (not shown in the drawings) and a second light receiving portion (not shown in the drawings). When the cartridge mount portion 8 is mounted in the cartridge case 3, for example, the second projecting portion 473B of the first indicator portion 473 is positioned to the right of the first light emitting portion, the second projecting portion 473B is positioned to the left of the first light receiving portion, the second indicator portion 483 is positioned to the right of the second light emitting portion, and the second indicator portion 483 is positioned to the left of the second light receiving portion.

When the first light receiving portion detects the light emitted by the first light emitting portion, the first optical detection portion outputs a value 1. When the second light receiving portion detects the light emitted by the second light emitting portion, the second optical detection portion outputs a value 1. When one of the first indicator portion 473 and the second indicator portion 483 blocks the light emitted by the first light emitting portion, the first light receiving portion does not detect the light, and thus the first optical detection portion outputs a value 0. When one of the first indicator portion 473 and the second indicator portion 483 blocks the light emitted by the second light emitting portion, the second light receiving portion does not detect the light, and thus the second optical detection portion outputs a value 0. A CPU (not shown in the drawings) of the printer 1 detects the amount of the remaining ink by detecting the combination of the output values 1 and 0 from the first optical detection portion and the second optical detection portion.

An operator may mount the cartridge case 3 in the cartridge mount portion 8 by pushing the front end of the cartridge case 3 into the opening 120 (refer to FIG. 1). At this time, the hollow needle (not shown in the drawings) pierces the rubber plug (not shown in the drawings) disposed in the spout 7 of the liquid container 31 accommodated in the cartridge case 3.

Figure 12B:
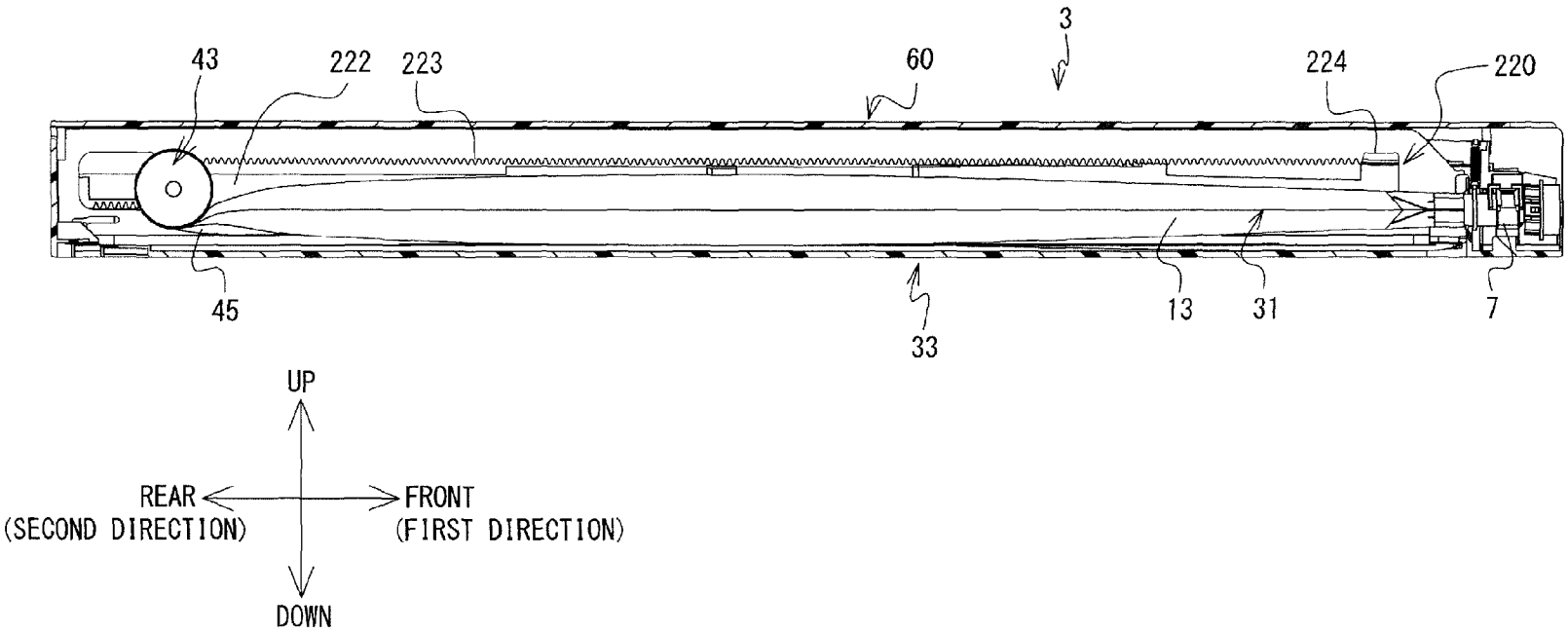
FIG. 12B is a section view of the cartridge case in the first state, as seen from the direction of arrows along a line X2-X2 in FIG. 2.

The first optical detection portion (not shown in the drawings) is disposed close to the first indicator portion 473. The second optical detection portion (not shown in the drawings) is disposed close to the second indicator portion 483. When the liquid container 31 of the cartridge case 3 has not yet been used, as shown in FIG. 12B, the shaft support portion 432 of the roll-up member 43 is positioned toward the rear from the first side plate 47 and the second side plate 48, as shown in FIG. 12A. At this time, the detection portion 46 is in the first state, in which the energizing force of the coil spring 461 (refer to FIG. 5) has put the first indicator portion 473 in its lower position and the second indicator portion 483 in its upper position. At this time, the second projecting portion 473B of the first indicator portion 473 blocks the light emitted by the first light emitting portion, and thus the first light receiving portion does not receive the light. The light from the second light emitting portion passes through under the second indicator portion 483, and thus the second light receiving portion receives the light. Therefore, the combination of the output values from the first optical detection portion and the second optical detection portion is 0, 1. By detecting the output values from the first optical detection portion and the second optical detection portion, the CPU of the printer 1 can detect the amount of the ink remaining in the liquid container 31.

When the printer 1 performs a printing operation, the hollow needle draws the ink from inside the liquid-holding portion 133 to the outside of the liquid container 31, and the nozzles of the printer 1 eject the ink. As shown in FIG. 13B, as the ink is drawn out, the energizing force of the elastic member 45 causes the roll-up member 43 to roll up the liquid container 31 and move toward the front.

Figure 13A:
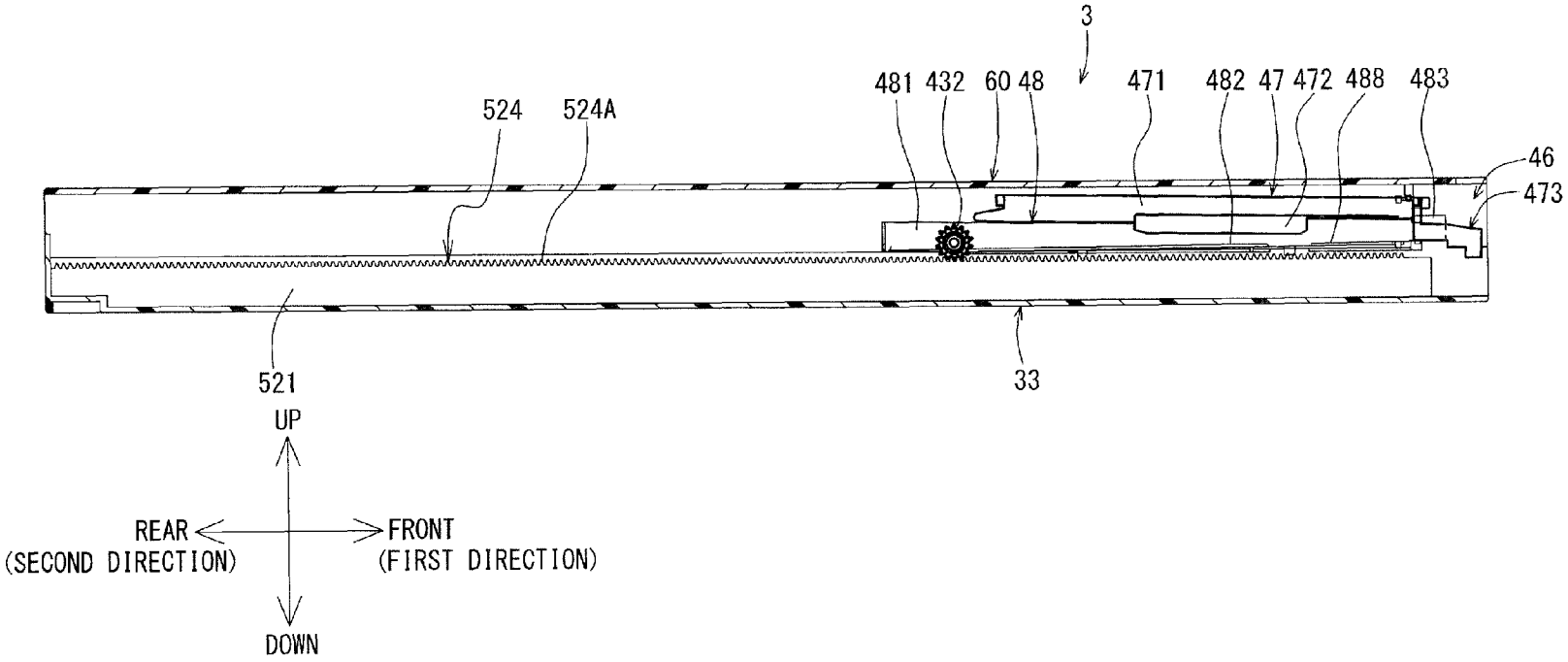
FIG. 13A is a section view of the cartridge case in a second state, in which consumption of an ink has progressed from the first state, as seen from the direction of the arrows along the line X1-X1 in FIG. 2.
Figure 13B:
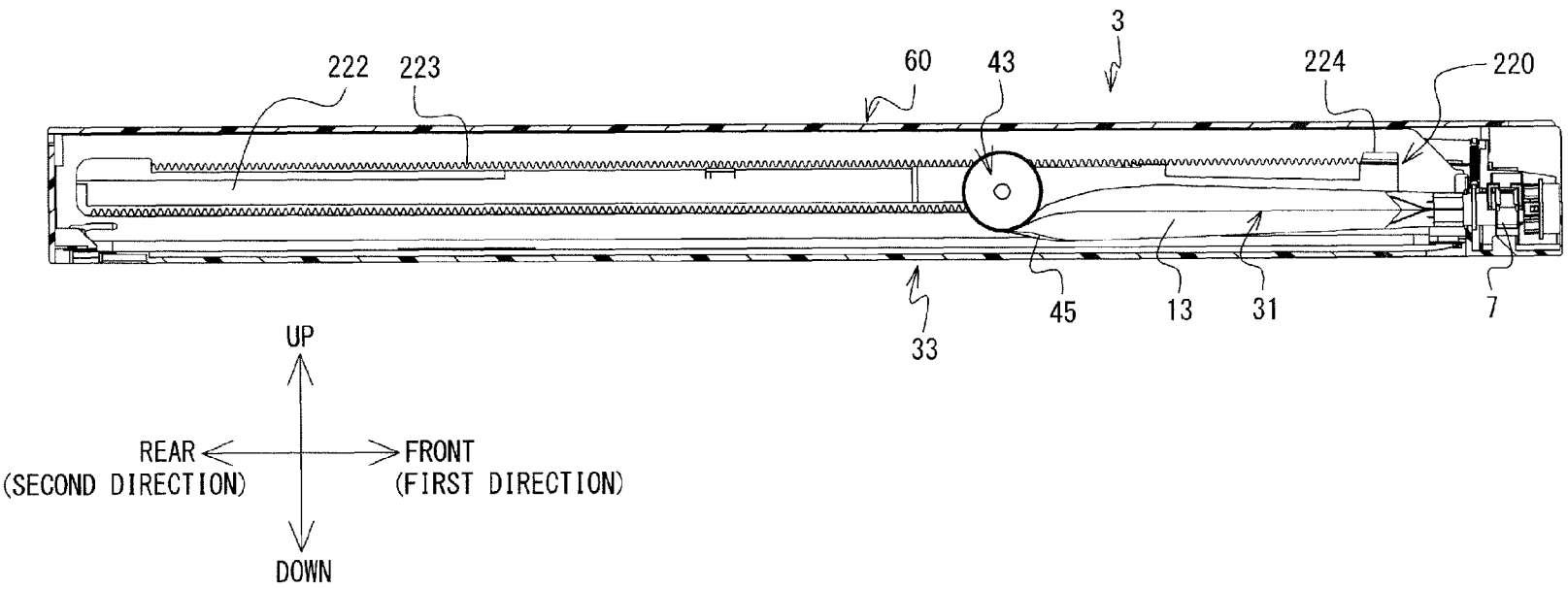
FIG. 13B is a section view of the cartridge case in the second state, as seen from the direction of the arrows along the line X2-X2 in FIG. 2.

As shown in FIGS. 13A and 13B, the roll-up member 43 moves to a first intermediate position. The first intermediate position is the position where the outer circumferential face of the shaft portion 432B of the shaft support portion 432 (refer to FIG. 9B) contacts the top face of the second contact portion 482 of the second side plate 48. At this time, the outer circumferential face of the shaft portion 432B does not contact the bottom face 479 of the first contact portion 472. As described above, the second contact portion 482 is disposed such that the second contact portion 482 becomes higher toward the front. Therefore, the outer circumferential face of the shaft portion 432B of the shaft support portion 432 presses the second contact portion 482 downward, causing the second indicator portion 483 of the second side plate 48 to rotate clockwise in a left side view against the energizing force of the coil spring 461. At this time, because the second indicator portion 483 moves downward, the first indicator portion 473 is subject to the downward energizing force of the coil spring 461. However, because the first side plate engaging portion 475 contacts the bottom face of the first support opening 542, the first indicator portion 473 does not move downward. Therefore, the detection portion 46 enters the second state, in which the first indicator portion 473 is in its lower position and the second indicator portion 483 is in its lower position. At this time, the second projecting portion 473B of the first indicator portion 473 blocks the light emitted by the first light emitting portion, and thus the first light receiving portion does not receive the light. The second indicator portion 483 blocks the light emitted by the second light emitting portion, and thus the second light receiving portion does not receive the light. Therefore, the combination of the output values from the first optical detection portion and the second optical detection portion is 0, 0.

Figure 14A:
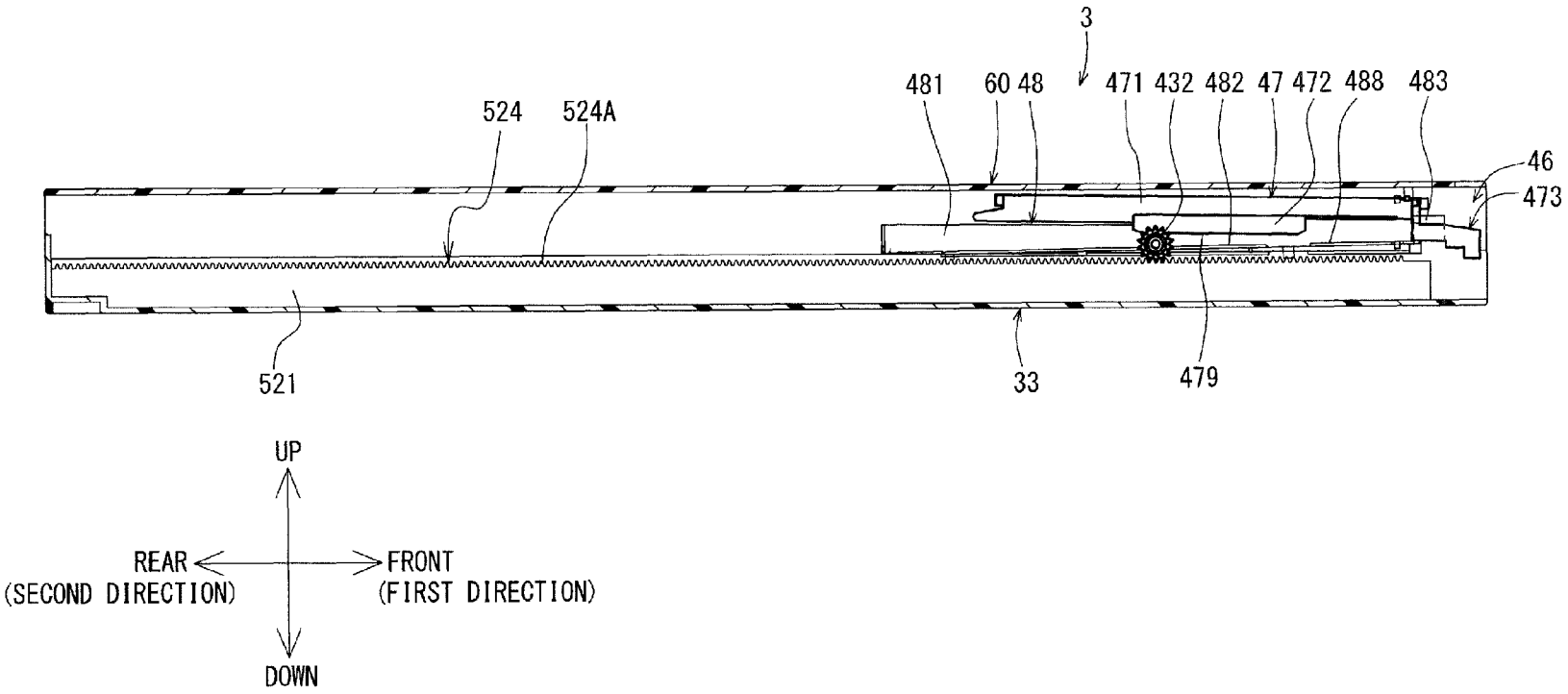
FIG. 14A is a section view of the cartridge case in a third state, in which the consumption of an ink has further progressed from the second state, as seen from the direction of the arrows along the line X1-X1 in FIG. 2.
Figure 14B:
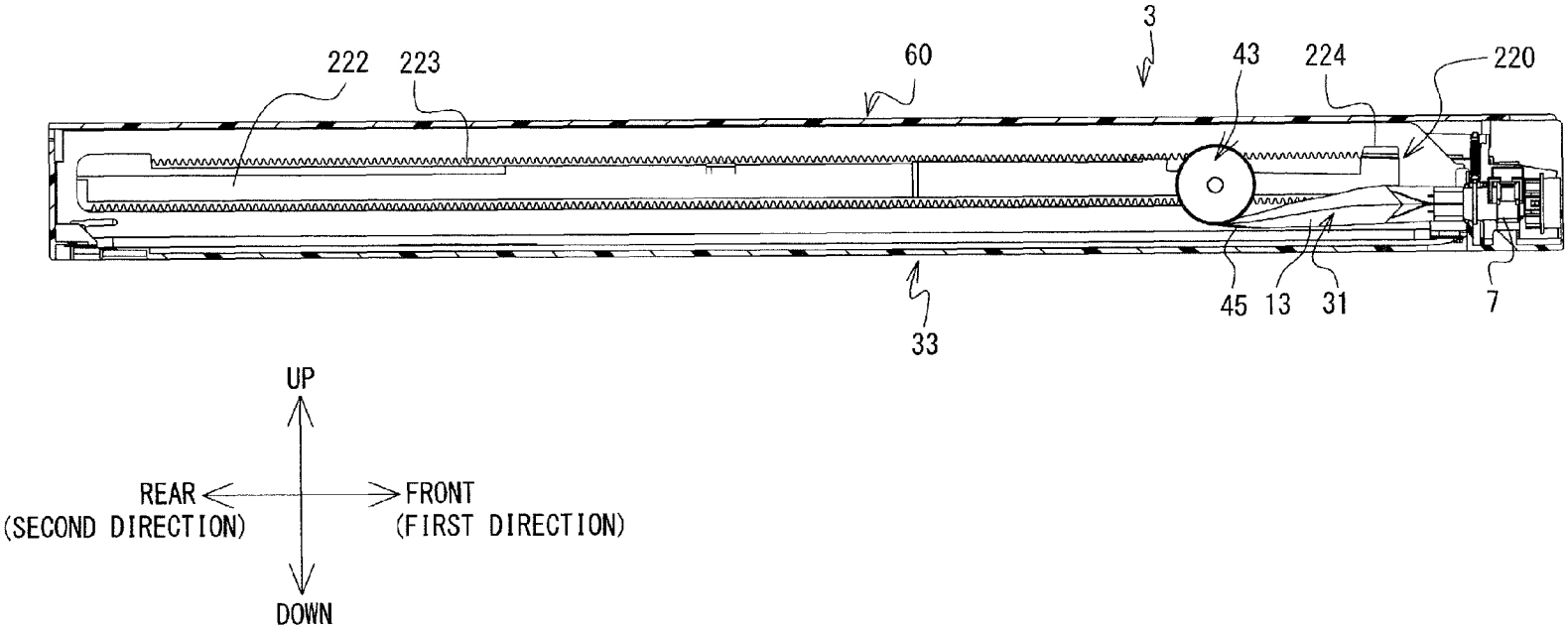
FIG. 14B is a section view of the cartridge case in the third state, as seen from the direction of the arrows along the line X2-X2 in FIG. 2.

As shown in FIGS. 14A and 14B, when ink is further drawn out by the printing operation, the roll-up member 43 moves to a second intermediate position. The second intermediate position is the position where the shaft portion 432B of the shaft support portion 432 (refer to FIG. 9B) contacts the top face of the second contact portion 482 and the bottom face 479 of the first contact portion 472. As described above, the first contact portion 472 is disposed such that it becomes lower toward the front. Therefore, the outer circumferential face of the shaft portion 432B of the shaft support portion 432 presses the bottom face 479 of the first contact portion 472 upward, causing the first indicator portion 473 of the first side plate 47 to rotate counterclockwise in a left side view against the energizing force of the coil spring 461. At this time, because the first indicator portion 473 moves upward, the second indicator portion 483 is subject to the upward energizing force of the coil spring 461. However, because the shaft portion 432B of the shaft support portion 432 (refer to FIG. 9B) contacts the top face of the second contact portion 482, the second indicator portion 483 does not move upward. Therefore, the detection portion 46 enters the third state, in which the first indicator portion 473 is in its upper position and the second indicator portion 483 is in its lower position. At this time, the light emitted by the first light emitting portion passes through under the second projecting portion 473B of the first indicator portion 473, and thus the first light receiving portion receives the light. The second indicator portion 483 blocks the light emitted by the second light emitting portion, and thus the second light receiving portion does not receive the light. Therefore, the combination of the output values from the first optical detection portion and the second optical detection portion is 1, 0.

Figure 15A:
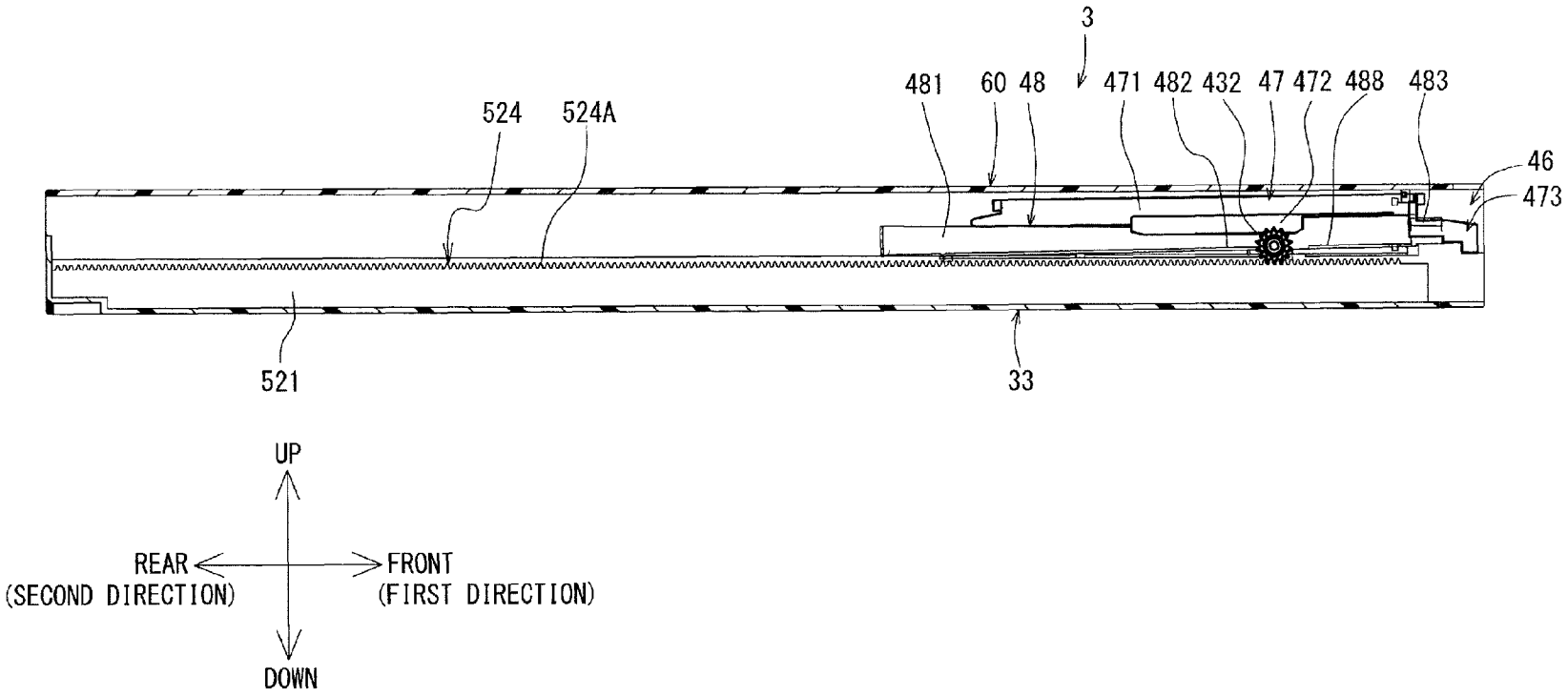
FIG. 15A is a section view of the cartridge case in a fourth state, in which the consumption of an ink has further progressed from the third state, as seen from the direction of the arrows along the line X1-X1 in FIG. 2.
Figure 15B:
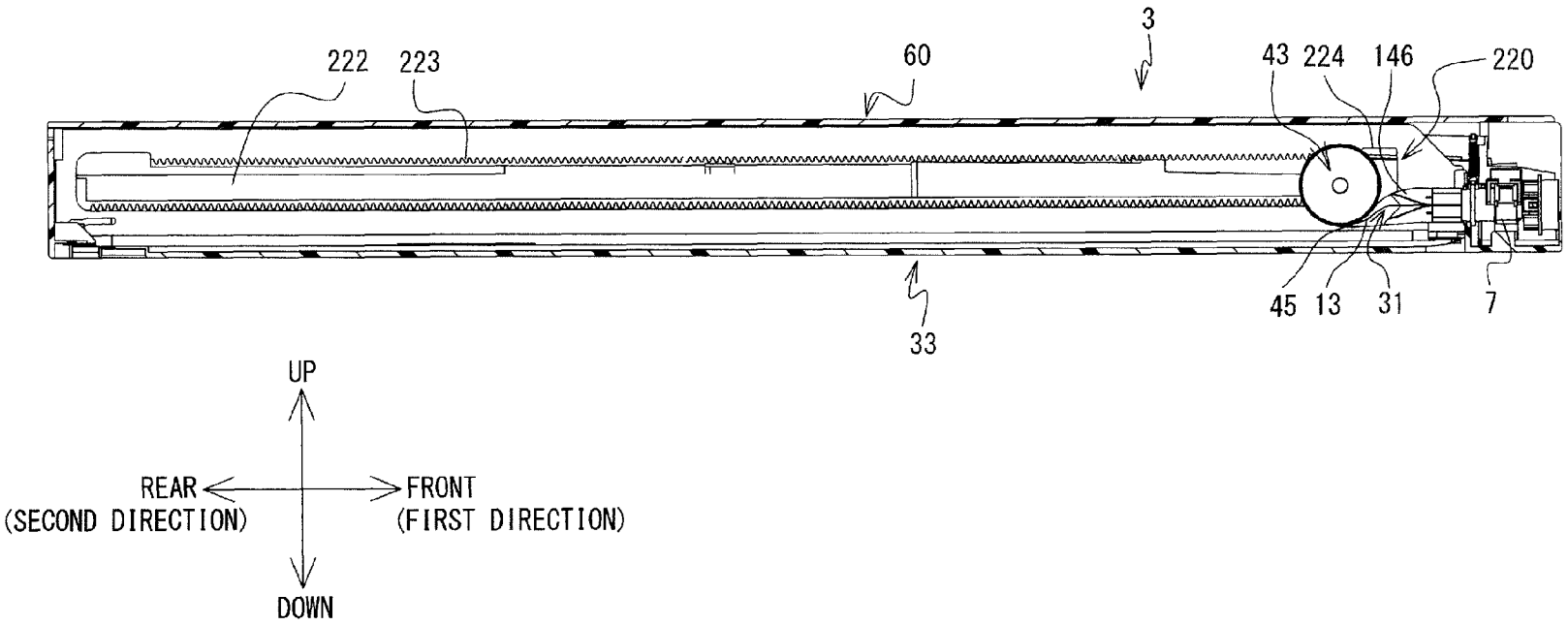
FIG. 15B is a section view of the cartridge case in the fourth state, as seen from the direction of the arrows along the line X2-X2 in FIG. 2.

As shown in FIGS. 15A and 15B, when ink is further drawn out by the printing operation, the roll-up member 43 moves to a third intermediate position. The third intermediate position is the position where the shaft portion 432B of the shaft support portion 432 (refer to FIG. 9B) is between the second contact portion 482 and the projecting portion 488 (refer to FIG. 5) and contacts the bottom face 479 of the first contact portion 472. At this time, the shaft portion 432B of the shaft support portion 432 does not contact either one of the second contact portion 482 and the projecting portion 488. The second indicator portion 483 of the second side plate 48 is rotated counterclockwise in a left side view by the energizing force of the coil spring 461. At this time, because the first indicator portion 473 is in its upper position, the second indicator portion 483 is subject to the upward energizing force of the coil spring 461. Because the shaft portion 432B of the shaft support portion 432 (refer to FIG. 9B) does not either one of the second contact portion 482 and the projecting portion 488, the second indicator portion 483 moves upward. Therefore, the detection portion 46 enters the fourth state, in which the first indicator portion 473 is in its upper position and the second indicator portion 483 is in its upper position. At this time, the light emitted by the first light emitting portion passes through under the second projecting portion 473B of the first indicator portion 473, and thus the first light receiving portion receives the light. The light emitted by the second light emitting portion passes through under second indicator portion 483, and the second light receiving portion receives the light. Therefore, the combination of the output values from the first optical detection portion and the second optical detection portion is 1, 1. By detecting the output values from the first optical detection portion and the second optical detection portion, the CPU of the printer 1 can detect the amount of the ink remaining in the liquid container 31. The CPU may display information that prompts the operator to replace the liquid container 31, for example.

As shown in FIG. 15B, when the shaft support portion 432 is between the second contact portion 482 and the projecting portion 488, the roll-up member 43 is positioned in the curved region 146 of the liquid bag 13. Rolling up the liquid container 31 in the curved region 146 is more difficult than rolling up the liquid container 31 in the area to the rear of the curved region 146. Therefore, the movement of the roll-up member 43 stops at the curved region 146. The position where the roll-up member 43 stops is the ending position of the movement of the roll-up member 43. The ending position of the movement of the roll-up member 43 may be the same as the third intermediate position (refer to FIG. 15B). The ending position of the movement of the roll-up member 43 may be farther toward the front from the third intermediate position.

As shown in FIG. 12B, when the ink in the liquid container 31 has not yet been consumed, the liquid container 31 has a constant thickness in the up-down direction. Hereinafter, this state is called the initial state. The cross-sectional surface area of the liquid container 31 in the left-right direction is a constant surface area, except in the vicinity of the roll-up member 43 and in the vicinity of the spout 7. Hereinafter, the cross-sectional surface area of the liquid container 31 in the left-right direction in the initial state is called the initial cross-sectional surface area. Even when the consumption of the ink in the liquid container 31 has progressed and the roll-up member 43 has rolled up the liquid container 31 to the first intermediate position (refer to FIG. 13B), the liquid container 31 still has a constant thickness in the up-down direction. At this time, the cross-sectional surface area of the liquid container 31 in the left-right direction is almost the same as the initial cross-sectional surface area, except in the vicinity of the roll-up member 43 and in the vicinity of the spout 7. Therefore, the pressure of the ink inside the liquid container 31, which is due to the energizing force that the elastic member 45 imparts to the roll-up member 43, is substantially the same as the pressure of the ink inside the liquid container 31 when the ink has not yet been consumed.

When the consumption of the ink in the liquid container 31 progresses and the roll-up member 43 rolls up the liquid container 31 to the second intermediate position (refer to FIG. 14B), the thickness of the liquid container 31 in the up-down direction becomes less than in the initial state. At this time, the cross-sectional surface area of the liquid container 31 in the left-right direction becomes less than the initial cross-sectional surface area. The pressure that the roll-up member 43 imparts to the liquid in the liquid container 31 corresponds to the energizing force of the elastic member 45 per unit cross-sectional surface area. Therefore, when the cross-sectional surface area of the liquid container 31 in the left-right direction decreases, the pressure of the ink inside the liquid container 31 increases, even if the energizing force of the elastic member 45 remains constant. In the present embodiment, when the shaft portion 432B of the shaft support portion 432 moves toward the front, the shaft portion 432B contacts the resistance portion 479E from the second intermediate position, and thus the resistance portion 479E applies resistance to the shaft portion 432B. The force that the roll-up member 43 applies to the ink in the liquid container 31 becomes weaker than in the initial state. Therefore, compared with when the resistance portion 479E is not provided on the bottom face 479 of the first contact portion 472, the pressure of the ink becomes closer to the pressure of the ink that had not yet been consumed in the liquid container 31. The range of fluctuation in the pressure of the ink therefore becomes smaller. It is therefore possible to reduce the possibility that the amount of ink ejected from the head portions of the head units 100 and 200 may become unstable. Therefore, deterioration in the quality of the printing on the print medium can be reduced.

When the consumption of the ink in the liquid container 31 progresses further and the roll-up member 43 rolls up the liquid container 31 to the third intermediate position (refer to FIG. 15B), the thickness of the liquid-holding container 31 in the up-down direction becomes less than when the roll-up member 43 is in the second intermediate position. At this time, the cross-sectional surface area of the liquid container 31 in the left-right direction becomes less than when the roll-up member 43 is in the second intermediate position. The first ridge-and-groove sets 479F of the resistance portion 479E increase in size toward the front. Specifically, the height of the first ridge-and-groove set 479F on the front end is greater than the height of the first ridge-and-groove set 479F on the rear end. As the roll-up member 43 moves from the second intermediate position to the third intermediate position, the resistance that the resistance portion 479E applies to the shaft portion 432B increases as the roll-up member 43 moves toward the front. The force that the roll-up member 43 applies to the ink in the liquid container 31 gradually weakens more than when the sizes of the first ridge-and-groove set 479F do not change. Therefore, compared with when the sizes of the first ridge-and-groove set 479F do not change, even if the cross-sectional surface area of the liquid container 31 in the left-right direction decreases, it is possible to reduce the possibility that the pressure of the ink may increase. Therefore, the pressure of the ink can be stabilized. It is therefore possible to reduce the possibility that the amount of ink ejected from the head portions of the head units 100 and 200 may become unstable. Therefore, deterioration in the quality of the printing on the print medium can be reduced.

As the roll-up member 43 moves toward the front, the outer circumferential face of the shaft portion 432B of the shaft support portion 432 slides from the rear edge 479C to the front edge 479D of the resistance portion 479E of the first contact portion 472. Compared with when the resistance portion 479E is not provided, the sliding resistance that acts on the outer circumferential face of the shaft portion 432B increases from the rear edge 479C toward the front edge 479D of the resistance portion 479E. When the roll-up member 43 is moved toward the front by the energizing force of the elastic member 45, the forward force that acts on the liquid container 31 from the roll-up member 43 becomes less than when the resistance portion 479E is not provided. The first side plate 47 and the second side plate 48 rotate around their respective rear ends, and their respective front ends are energized toward one another by the energizing force of the coil spring 461. Therefore, if the resistance portion 479E is not provided, the sliding resistance that bears on the outer circumferential face of the shaft portion 432B will be less as the roll-up member 43 moves toward the front. Even though the cross-sectional surface area of the liquid container 31 in the left-right direction becomes smaller as the roll-up member 43 rolls up the liquid container 31, it is possible to reduce the possibility that the pressure of the ink may increase. Therefore, the range of fluctuation in the pressure of the ink becomes smaller. It is therefore possible to reduce the possibility that the amount of ink ejected from the head portions of the head units 100 and 200 may become unstable. Therefore, deterioration in the quality of the printing on the print medium can be reduced.

The resistance portion 479E is provided on the first contact portion 472. The first contact portion 472 is a contact portion that the shaft portion 432B of the roll-up member 43 contacts. The resistance between the bottom face 479 of the first contact portion 472 and the shaft portion 432B of the roll-up member 43 is increased by the resistance portion 479E. The resistance bears on the shaft portion 432B of the roll-up member 43 that moves toward the front. Therefore, in the situation where the cross-sectional surface area of the liquid container 31 in the left-right direction becomes smaller, the increase in the pressure on the ink inside the liquid bag 13 can be reduced more reliably, and thus the range of fluctuation in the pressure of the ink can be reduced more reliably. The resistance bears on a part of the roll-up member 43 other than the parts that contact with the liquid container 31. It is therefore possible to eliminate an effect on the rolling-up of the liquid container 31 that arise when the resistance portion 479E is disposed at a point where the resistance portion 479E contacts the liquid container 31.

Instead of being provided with the first ridge-and-groove sets 479F, the resistance portion 479E may be a friction surface to which a rubber plate or the like is affixed. The resistance portion may be simply a rubber plate or the like affixed to the existing first side plate 47. The elastic member 45 may be provided with a variable-load spring, instead of providing the resistance portion 479E. In that case, the load may be reduced by the variable-load spring after the roll-up member 43 moves to the second intermediate position (refer to FIG. 14B).

The resistance portion 479E consists of the first ridge-and-groove sets 479F provided on the bottom face 479 of the first contact portion 472. The first contact portion 472 is the contact portion that the shaft portion 432B contacts. The first ridge-and-groove sets 479F of the bottom face 479 contact the shaft portion 432B of the roll-up member 43 and apply resistance to the shaft portion 432B. Because the face that contacts the shaft portion 432B consists of ridges and grooves, the rolling-up by the roll-up member 43 uniformly proceeds in accordance with the pitch of the first ridge-and-groove sets 479F. Therefore, the rotation of the roll-up member 43 is stable, reducing the possibility that fluctuation may occur in the pressure on the ink inside the liquid bag 13. It is possible to reduce the possibility that the amount of ink ejected from the head portions of the head units 100 and 200 may become unstable. In contrast, if the ridges and grooves are not provided on the resistance portion 479E, a stick-slip phenomenon will occur between the friction surfaces. The stick-slip phenomenon is a phenomenon in which successive sticking and slipping occur repeatedly. In that case, the rolling-up by the roll-up member 43 proceeds at a non-uniform pitch. Therefore, fluctuation in the pressure of the ink inside the liquid bag 13 becomes greater.

It is preferable for the size of the first ridge-and-groove sets 479F to be from 0.01 millimeters to 0.2 millimeters. In that case, the cross-sectional surface area of the liquid container 31 becomes smaller as the roll-up member 43 rolls up the liquid container 31, but the range of fluctuation in the pressure of the liquid reliably becomes smaller. Therefore, the pressure of the liquid reliably becomes stabilized.

If the shaft portion 432B of the roll-up member 43 is provided with the second ridge-and-groove sets, when the second ridge-and-groove sets mesh with the first ridge-and-groove sets 479F, which are provided on the bottom face 479 of the first contact portion 472, resistance is applied to the shaft portion 432B. The size of the first ridge-and-groove sets 479F is not so large as to lock the rotation of the shaft portion 432B. The bottom face 479 of the first contact portion 472 is provided with the first ridge-and-groove sets 479F, and the outer circumferential face of the shaft portion 432B is provided with the second ridge-and-groove sets. Therefore, the outer circumferential face of the shaft portion 432B does not readily stick on the bottom face 479. Therefore, the stick-slip phenomenon is even more unlikely to occur between the friction surfaces.

The resistance portion 479E contacts the shaft portion 432B from a contact direction. The contact direction is the direction from the center of the shaft portion 432B toward the top face of the lower support portion 524. The lower support portion 524 is the rolling surface on which the shaft portion 432B of the roll-up member 43 rolls. Therefore, the shaft portion 432B is in sliding contact with the resistance portion 479E, and the shaft portion 432B is in rolling contact with the top face of the lower support portion 524. Therefore, the resistance portion 479E can generate resistance to the movement of the roll-up member 43 toward the front more reliably than when the resistance portion 479E is provided on the top face of the lower support portion 524.

The rolling surface on which the shaft portion 432B of the roll-up member 43 rolls is the rack 524A, which extends in the first direction. The outer circumferential shape of the shaft portion 432B in vertical cross section is circular. The shaft portion 432B rolls on top of the rack 524A. The resistance portion 479E contacts the shaft portion 432B on the opposite side from the rack 524A. Therefore, the shaft portion 432B can roll reliably, without sliding on top of the lower support portion 524.

The resistance portion 479E has a shape in which the resistance increases toward the front. For example, as described above, the heights of the ridges of the first ridge-and-groove sets 479F may increase from the rear edge 479C end to the front edge 479D end. Therefore, because the resistance of the resistance portion 479E increases toward the front, when the roll-up member 43 is moved toward the front by the energizing force of the elastic member 45, the forward force that acts on the liquid container 31 from the roll-up member 43 diminishes toward the front. Therefore, the cross-sectional surface area of the liquid container 31 in the left-right direction becomes smaller as the roll-up member 43 rolls up the liquid container 31, but the range of fluctuation in the pressure of the ink inside the liquid bag 13 becomes smaller.

The ridges and grooves of the first ridge-and-groove sets 479F are larger than any ridges and grooves in the inclined face 479A, which is a flat face provided on the rear end of the bottom face 479. The shaft portion 431B of the roll-up member 43 may either contact or not contact the inclined face 479A. After contacting the inclined face 479A, the forward-moving shaft portion 431B contacts the first ridge-and-groove sets 479F. Therefore, the roll-up member 43 readily moves smoothly and thus can roll up the liquid container 31 smoothly.

The resistance of the resistance portion 479E may increase gradually toward the front. The resistance of the resistance portion 479E may increase toward the front in incremental steps. The resistance portion 479E may be provided with an area that has the first ridge-and-groove sets 479F and with an area that does not have the first ridge-and-groove sets 479F. In that case, the front portion of the resistance portion 479E may be the area that has the first ridge-and-groove sets 479F, and the rear portion of the resistance portion 479E may be the area that does not have the first ridge-and-groove sets 479F. The ridges and grooves in the area that has the first ridge-and-groove sets 479F are larger than any ridges and grooves in the area that does not have the first ridge-and-groove sets 479F. In that case, the forward-moving shaft portion 431B contacts the area that has the first ridge-and-groove sets 479F after contacting the area that does not have the first ridge-and-groove sets 479F. Therefore, the roll-up member 43 readily moves smoothly and thus can roll up the liquid container 31 smoothly.

When the bottom face 479 of the first contact portion 472 contacts the shaft portion 431B of the roll-up member 43, the first arm portion 471 is moved in a third direction (the upward direction), which is orthogonal to both the first direction (the frontward direction) and the orthogonal direction (the left-right direction). Therefore, the first indicator portion 473 moves upward to indicate the position of the roll-up member 43. The resistance portion 479E is provided on the bottom face 479 of the first contact portion 472 of the first side plate 47. Therefore, the resistance portion 479E does not need to be provided on a separate member from the first side plate 47, so that the structure of the cartridge case 3 does not become more complex.

Various modifications can be made to the above embodiment. For example, the top side of the cartridge case 3 may be open, instead of being provided with the second case 60. The second contact portion 482 may be provided with a resistance portion. Examples of a contact portion that the shaft portion 432B of the roll-up member 43 contacts will be shown below. For example, the top face of the second contact portion 482 may be provided with the resistance portion. The left face of the second contact portion 482 may be provided with the resistance portion. The slide opening 222 of the presser plate 220 may be provided with a resistance portion. As shown in FIG. 7, a rib 65 forms a guide groove for the shaft portion 431B in the second case 60. A tip 651 of the rib 65 may be provided with a resistance portion.

It is acceptable for the elastic member 45 not to be disposed inside the case 32. In the above embodiment, the lower support portions 514 and 524 are provided on the lower side, which is the first inner face 344 side, and the shaft portions 431B and 432B roll on the lower support portions 514 and 524, respectively. However, the shaft portion 431B may roll on a support portion provided on the upper side of the shaft portion 431B, and a resistance portion may be provided on the lower side of the shaft portion 431B. For example, a rack may be provided on the tip 651 of the rib 65, and the shaft support portion 432 may roll on the rack. Ridge-and-groove sets may be provided as a resistance portion on the lower support portion 524 to first case 33. The resistance portion 479E may be provided from somewhere along the bottom face 479 to the front edge 479D, instead of from the rear edge 479C. In the above embodiment, the shaft portion 432B contacts the bottom face 479. However, the rotary gear 432A may contact the bottom face 479. The rotary gear 432A may have a circular shape in cross section, instead of being a pinion gear.

Figure 16:
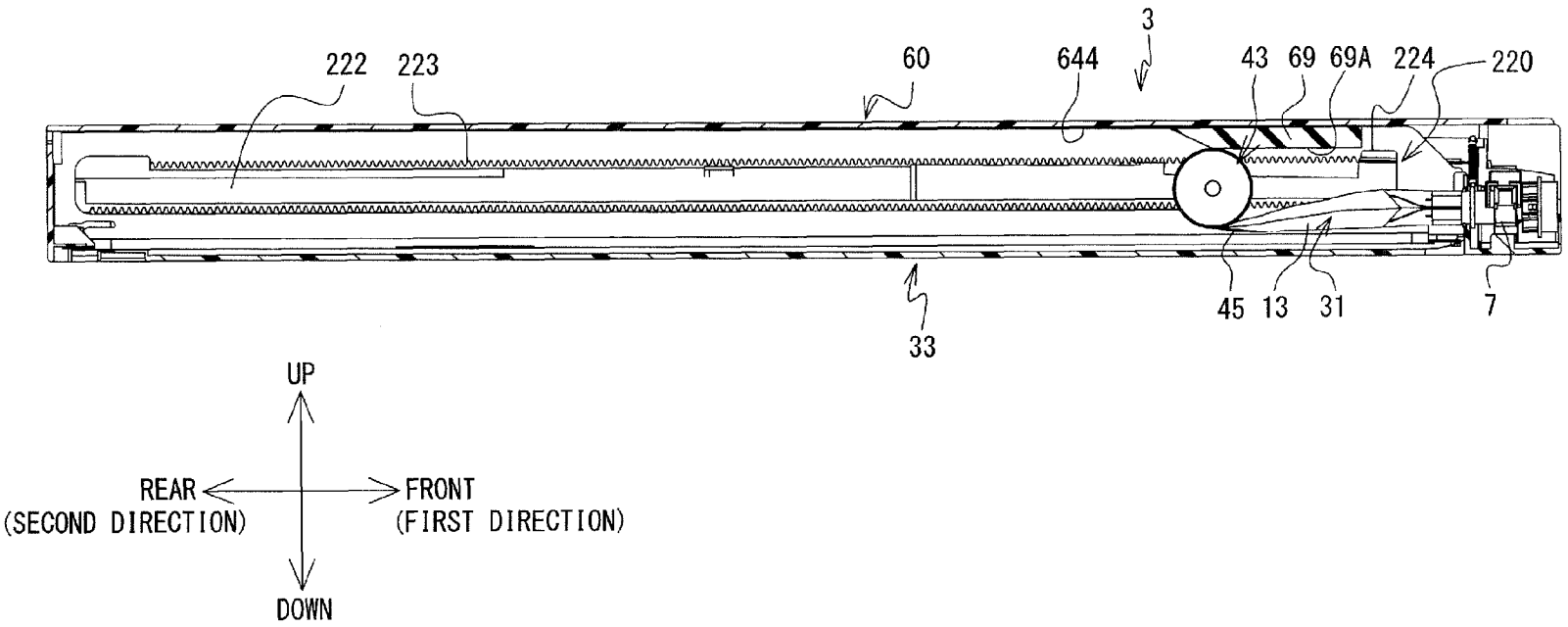
FIG. 16 is a section view of the cartridge case of a second embodiment, as seen from the direction of the arrows along the line X2-X2 in FIG. 2.

According to a second embodiment shown in FIG. 16, a resistance portion 69 may be provided on the second inner face 644 of the second case 60. For example, the resistance portion 69 may be a member that has a constant thickness from the second inner face 644 toward the first inner face 344 and that has a specified size in the front-rear direction and the left-right direction. A bottom face 69A of the resistance portion 69 may be a friction surface provided with ridge-and-groove sets. In that case, the bottom face 69A of the resistance portion 69 contacts the surface of the liquid container 31 rolled up by the roll-up member 43 and thus applies resistance to the forward movement of the roll-up member 43. The resistance portion 69 may be a plate-shaped piece of rubber affixed to the second inner face 644. The resistance portion 69 may be formed as a single unit with the second case 60. The position of the resistance portion 69 within the second case 60 may be the same as that of the first contact portion 472 in the first direction, in the center or the like of the left-right direction within the second case 60. In that case, the resistance portion 69 can be implemented with a simple structure that provides a protuberance in the second inner face 644 of the second case 60.

The heights of the ridge-and-groove sets on the bottom face 69A of the resistance portion 69 may vary in the same manner as those on the resistance portion 479E in the first embodiment, and the frictional resistance between the bottom face 69A and the liquid container 31 may increase in the first direction. The bottom face 69A of the resistance portion 69 may be an inclined surface that inclines downward toward the first inner face 344. In that case, the resistance of the resistance portion 69 can increase in the first direction.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A cartridge case comprising:

a case including a first face extending in a first direction and an orthogonal direction orthogonal to the first direction;

a spout support portion provided on an end portion side of the case, the end portion side being a side on which an end portion of the case is provided in the first direction, and the spout support portion being configured to support a spout provided on a liquid container containing an inkjet liquid, the liquid container having a rear end portion on an opposite side from the spout;

a mount portion provided on the end portion side of the case, an end portion of an elastic member being mountable in the mount portion, the end portion of the elastic member being provided on the first direction side, the elastic member extending in a second direction, the second direction being an opposite direction from the first direction, and the elastic member generating an energizing force in the first direction;

a roll-up member extending in the orthogonal direction, and the roll-up member configured to roll up the liquid container by being moved in the first direction by the energizing force of the elastic member; and a resistance portion configured to generate resistance to movement of the roll-up member in the first direction at the end portion side of the case, the resistance portion being configured to increase the resistance as the roll-up member moves in the first direction, the first direction being a direction from the rear end portion toward the spout.

2. The cartridge case according to claim 1, wherein the roll-up member includes a shaft portion;

the resistance portion is provided on a contact portion configured to contact the shaft portion.

3. The cartridge case according to claim 2, wherein the resistance portion is a first ridge-and-groove set provided on the contact portion.

4. The cartridge case according to claim 3, further comprising:

a flat portion provided on a second direction side of the first ridge-and-groove set, wherein a distance between a top of the first ridge and a bottom of the groove is greater than a distance between a top of a ridge and a bottom of a groove in the flat portion.

5. The cartridge case according to claim 3, wherein a distance between a top of the first ridge and a bottom of the groove is from 0.01 millimeters to 0.2 millimeters.

6. The cartridge case according to claim 3, wherein the shaft portion is provided with a second ridge-and-groove set, the second ridge-and-groove set being configured to mesh with the first ridge-and-groove set.

7. The cartridge case according to claim 2, further comprising:

a rolling surface on which the shaft portion rolls, wherein the resistance portion is configured to contact the shaft portion from a contact direction, the contact direction being a direction from a center of the shaft portion toward the rolling surface.

8. The cartridge case according to claim 7, wherein the rolling surface is a rack extending in the first direction, an outer circumferential shape of the shaft portion is circular in a cross section orthogonal to the orthogonal direction, and the contact portion is configured to contact the shaft portion on an opposite side of the shaft portion from the rack.

9. The cartridge case according to claim 2, wherein the resistance portion has a shape of a first ridge-and-groove set configured to increase the resistance in the first direction.

10. The cartridge case according to claim 9, wherein the resistance portion is the first ridge-and-groove set provided on the contact portion, and a distance between a top of the first ridge and a bottom of the groove on a side in the first direction is greater than a distance between a top of the first ridge and a bottom of the groove on a side in the second direction.

11. The cartridge case according to claim 2, further comprising:

a side plate provided on an end portion side of the case in the orthogonal direction, the side plate extending in the first direction; and a movable portion provided on an end portion side of the side plate in the first direction, the movable portion configured to move in a third direction as the side plate contacts with the shaft portion of the roll-up member moving in the first direction, and the third direction being a direction orthogonal to the first direction and the orthogonal direction wherein the contact portion is a face provided on a first face side of the side plate.

12. The cartridge case according to claim 1, further comprising:

a second face opposed to the first face, wherein the resistance portion is provided on the second face, and the resistance portion is configured to contact an outer circumferential face of the liquid container rolled up by the roll-up member.

* * * * *